US008978944B2

(12) United States Patent
Mori et al.

(10) Patent No.: US 8,978,944 B2
(45) **Date of Patent: *Mar. 17, 2015**

(54) CLAMP BRACES AND RELATED METHODS

(71) Applicant: Belkin International, Inc., Playa Vista, CA (US)

(72) Inventors: Kenneth Mori, Los Angeles, CA (US); Sarahut Sirichai, Shatin (HK)

(73) Assignee: Belkin International, Inc., Playa Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/109,530

(22) Filed: Dec. 17, 2013

(65) Prior Publication Data

US 2014/0144954 A1 May 29, 2014

Related U.S. Application Data

(63) Continuation of application No. 12/272,555, filed on Nov. 17, 2008, now Pat. No. 8,608,036.

(60) Provisional application No. 61/003,514, filed on Nov. 16, 2007.

(51) Int. Cl.

| | |
|---|---|
| ***A45F 3/14*** | (2006.01) |
| ***A45F 5/00*** | (2006.01) |
| ***A45C 11/00*** | (2006.01) |
| *A45F 5/02* | (2006.01) |

(52) U.S. Cl.

CPC . *A45C 11/00* (2013.01); *A45F 3/14* (2013.01); *A45F 5/02* (2013.01); *A45F 2005/008* (2013.01); *A45F 2200/0516* (2013.01)

USPC ..... 224/222; 224/219; 224/267

(58) Field of Classification Search

USPC ..... 224/222, 164, 219, 267; 24/68 R, 69 ST, 24/71 ST

See application file for complete search history.

(56) References Cited

U.S. PATENT DOCUMENTS

| | | | | |
|---|---|---|---|---|
| 519,546 | A * | 5/1894 | McClure | 24/193 |
| 897,115 | A * | 8/1908 | Lindberg et al. | 24/71 ST |
| 1,514,790 | A * | 11/1924 | Range | 24/71 ST |
| 1,673,117 | A * | 6/1928 | Kestenman | 24/71 J |
| 1,778,313 | A | 10/1930 | Darling | |
| 2,500,649 | A * | 3/1950 | Szeglin | 24/71 J |
| 3,147,607 | A * | 9/1964 | Calvano et al. | 70/64 |
| 3,387,346 | A * | 6/1968 | Hasenbank | 24/270 |

(Continued)

OTHER PUBLICATIONS

Patent Cooperation Treaty PCT Written Opinion of the International Searching Authority for International Application No. PCT/US2008/083805, Jan. 15, 2009, 8 pages.

*Primary Examiner* — Justin Larson
*Assistant Examiner* — Lester L Vanterpool
(74) *Attorney, Agent, or Firm* — Bryan Cave LLP

(57) ABSTRACT

In one embodiment, an apparatus to carry a portable device comprises a brace body, an adjustment mechanism coupled to the brace body, and a locking mechanism coupled to the brace body. The adjustment mechanism is configured to adjust the apparatus for an adjusted fit and to retain the adjusted fit for the apparatus when not in use. The locking mechanism is configured to conform to a locked state to configure the apparatus for a bracing fit and to conform to an unlocked state to configure the apparatus for a relaxed fit. The bracing fit is configured to brace the apparatus at a usage position, and the relaxed fit permits positioning of the apparatus relative to the usage position.

20 Claims, 11 Drawing Sheets

(56) References Cited

U.S. PATENT DOCUMENTS

| | | | | | |
|---|---|---|---|---|---|
| 3,797,077 | A | * | 3/1974 | Omori et al. | 24/273 |
| 4,116,374 | A | * | 9/1978 | Garello | 294/150 |
| 4,379,359 | A | * | 4/1983 | Young | 24/273 |
| 4,428,369 | A | | 1/1984 | Peckham et al. | |
| 4,432,447 | A | * | 2/1984 | Tanaka | 194/318 |
| 4,545,095 | A | * | 10/1985 | Fontana | 24/71 J |
| 4,545,522 | A | | 10/1985 | Kerzner | |
| 4,546,522 | A | * | 10/1985 | Gygax | 24/71 J |
| 4,777,703 | A | * | 10/1988 | Knox | 24/71 ST |
| 4,932,104 | A | * | 6/1990 | Kowal | 24/170 |
| 5,154,506 | A | * | 10/1992 | Leard | 362/103 |
| 5,582,337 | A | | 12/1996 | McPherson et al. | |
| 5,927,577 | A | | 7/1999 | Braun | |
| 6,175,729 | B1 | | 1/2001 | He et al. | |
| 6,192,835 | B1 | | 2/2001 | Calhoun et al. | |
| 6,543,097 | B2 | | 4/2003 | Burt et al. | |
| 7,296,658 | B1 | * | 11/2007 | Pederson | 182/133 |
| 2002/0084295 | A1 | * | 7/2002 | Martindale et al. | 224/219 |
| 2003/0028215 | A1 | | 2/2003 | Brooks | |
| 2004/0084489 | A1 | * | 5/2004 | Murphey et al. | 224/221 |
| 2005/0049630 | A1 | | 3/2005 | Ambach | |
| 2005/0242137 | A1 | * | 11/2005 | Fishman et al. | 224/221 |
| 2006/0124675 | A1 | * | 6/2006 | Calicott | 224/222 |
| 2010/0200627 | A1 | * | 8/2010 | Shen | 224/222 |

* cited by examiner

CLAMP BRACES AND RELATED METHODS

CLAIM OF PRIORITY

This application is a continuation of U.S. patent application Ser. No. 12/272,555, filed on Nov. 17, 2008, which claims priority to U.S. Provisional Patent Application No. 61/003,514, filed on Nov. 16, 2007. The disclosures of the applications listed above are incorporated by reference.

TECHNICAL FIELD

This disclosure relates generally to braces, and relates more particularly to clamp braces and methods for manufacturing, selling, and using the same.

BACKGROUND

Modern day electronics have become increasingly portable, allowing users an unprecedented degree of freedom and mobility with respect to electronic and/or wireless communications and entertainment. For example, electronic devices such as cellular telephones, personal digital assistants, and digital music players have become smaller and more functional, allowing users to carry them wherever they go. Users, however, have not evolved as fast as electronic devices, and still have only two hands to juggle their daily routines. Oftentimes, a user might not want to hand-carry an electronic device, such as to free her hands or use her hands for other purposes. In such situations, a brace can be configured to wield the electronic device in a hands-free manner. A need still exists, however, for braces that can securely wield portable devices and that can be easily and quickly positioned and/or removed from a usage position on the user.

Figure 1:
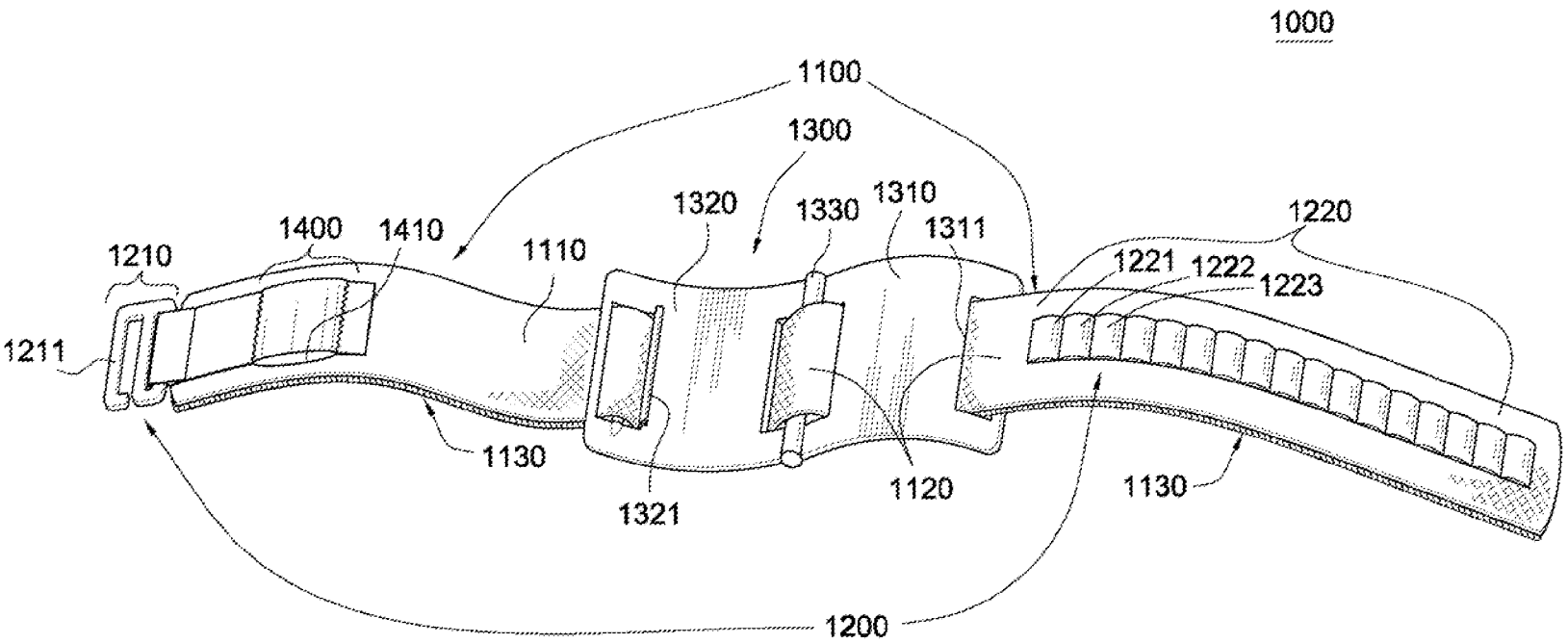
FIG. 1 illustrates an isometric view of a first apparatus or brace, in an unadjusted and unlocked configuration, according to a first embodiment.

For simplicity and clarity of illustration, the drawing figures illustrate the general manner of construction, and descriptions and details of well-known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described in the present disclosure are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described in the present disclosure are, for example, capable of operation in other orientations than those illustrated or otherwise described herein. The term "coupled," as used herein, is defined as directly or indirectly connected in a physical, mechanical, or other manner.

The terms "couple," "coupled," "couples," "coupling," and the like should be broadly understood and refer to connecting two or more elements, mechanically and/or otherwise, either directly or indirectly through intervening elements. Coupling may be for any length of time, e.g., permanent or semi-permanent or only for an instant. The absence of the word "removably," "removable," and the like near the word "coupled," and the like does not mean that the coupling, etc. in question is or is not removable.

DESCRIPTION

In one embodiment, an apparatus to carry a portable device comprises a brace body, an adjustment mechanism coupled to the brace body, and a locking mechanism coupled to the brace body. The adjustment mechanism is configured to adjust the apparatus for an adjusted fit and to retain the adjusted fit for the apparatus when not in use. The locking mechanism is configured to conform to a locked state to configure the apparatus for a bracing fit and to conform to an unlocked state to configure the apparatus for a relaxed fit. The bracing fit is configured to brace the apparatus at a usage position, and the relaxed fit permits positioning of the apparatus relative to the usage position.

Figure 2:
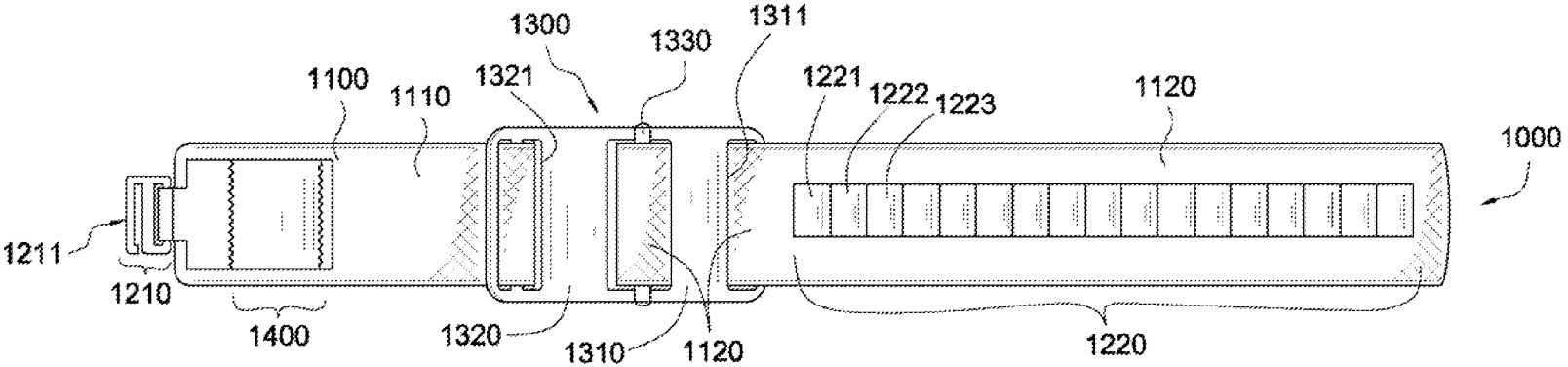
FIG. 2 illustrates a top view of the brace of FIG. 1.
Figure 3:
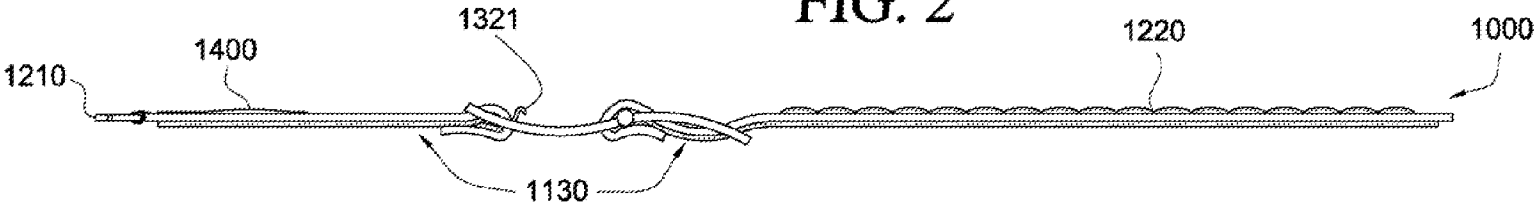
FIG. 3 illustrates a side view of the brace of FIG. 1.
Figure 4:
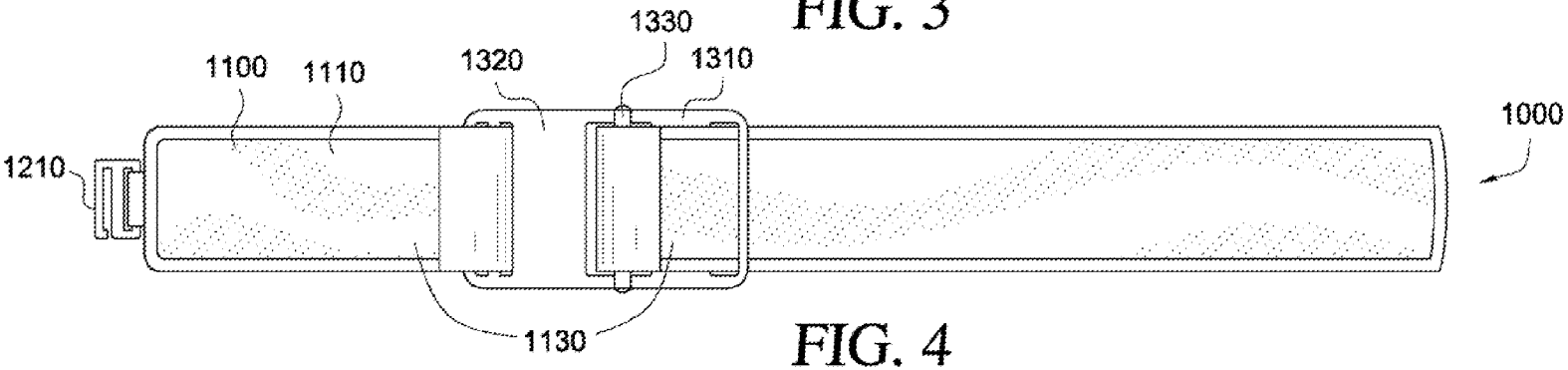
FIG. 4 illustrates a bottom view of the brace of FIG. 1.

Referring now to the figures, FIG. 1 illustrates an isometric view of an apparatus or brace 1000, in an unadjusted and unlocked configuration. FIG. 2 illustrates a top view of brace 1000. FIG. 3 illustrates a side view of brace 1000. FIG. 4 illustrates a bottom or underside view of brace 1000. In the example shown in FIGS. 1-4, brace 1000 can be any kind of attachment device capable of being worn on the body of a user, and normally employed to comfortably wield portable devices in a hands-off manner. Brace 1000 can represent, for example, an armband, a headband, a wristband, a belt, an ankleband and other similar devices, although brace 1000 is merely exemplary and is not limited to the embodiments presented herein. The functional aspects of brace 1000 can be employed in many different devices not specifically depicted or otherwise described herein.

In the present embodiment, brace 1000 comprises a brace body 1100, an adjustment mechanism 1200, a locking mechanism 1300, and a wielding mechanism 1400. In the illustrated embodiment, brace body 1100 comprises a brace band 1110 and a brace band 1120, both coupled together via locking mechanism 1300. In a different embodiment, brace body 1100 can comprise a single brace band routed through locking mechanism 1300. In other embodiments, brace body 1100 can comprise more than two brace bands coupled to each other to permit further expansion of the length of the brace.

Brace body 1100 can include a skin-protective exterior 1130 made of a skin-friendly material, and designed to protect the skin or clothes of users from pinching or other related harms while wearing brace 1000. The skin-friendly material used for skin-protective exterior 1130 can include one of or a combination of more thane one of leather, cloth, fabric, foam, wool, cotton, neoprene, and/or other similar materials with skin-protective characteristics. In the present embodiment, skin-protective exterior 1130 is coupled to the underside of brace bands 1110 and 1120, covering areas of brace body 1100 likely to come into contact with skin or clothes of users when brace 1000 is worn. In a different embodiment, skin-protective exterior 1130 can encase brace body 1100, covering its entire underside and topside surface. In other embodiments, skin-protective exterior 1130 can comprise of the inherent exterior surface of brace body 1100, where brace body 1100, or at least brace bands 1110 and 1120, is made of skin-friendly material.

Brace 1000 comprises adjustment mechanism 1200, which is designed to allow users to adjust brace 1000 from a variety of lengths to an adjusted fit customized by a user for a desired usage position. In one example, the desired usage position can be a part of the user's body to which the user wants to hold brace 1000 while in use. In one embodiment, the desired usage position can be located proximate to an arm, an upper arm, a bicep, a forearm, a wrist, a head, an ankle, an upper leg, a lower leg, a waist, or another location to which brace 1000 can be braced to wield, for example, portable devices in a hands-off manner. The adjusted fit serves to pre-determine and retain measurements for a custom configuration that can securely hold brace 1000 at the desired usage position while brace 1000 is worn. Adjustment mechanism 1200 is normally capable of retaining the adjusted fit as configured by users, even when brace 1000 is not in use, such that a user does not have to readjust the adjusted fit each time she wears brace 1000.

In the present embodiment, adjustment mechanism 1200 is coupled to brace body 1100, and consists of adjustment elements 1210 and 1220, where adjustment element 1210 couples to brace band 1110, and adjustment element 1220 couples to brace band 1120. In a different embodiment, adjustment elements 1210 and 1220 can be coupled to different regions of a single brace band comprising brace body 1100, such as to opposite ends of brace body 1100 as formed by the single brace band, and/or to opposite extremes of the single brace band. In another embodiment, adjustment mechanism 1200 can be coupled to brace body 1100 by being attached or spread across more than two brace bands of brace body 1100.

In the present embodiment, adjustment mechanism 1200 includes a hook and loop mechanism comprising adjustment elements 1210 and 1220. Adjustment element 1210 comprises hook 1211, and adjustment element 1220 comprises loop 1221. Adjustment element 1220 can also comprise, as illustrated in the present embodiment, several loops such as loop 1221, loop 1222, and loop 1223. Similarly, in other embodiments, adjustment element 1210 can comprise several hooks in addition to hook 1211. In the present embodiment, hook 1211 is designed to allow users to configure brace 1000 to the adjusted fit by latching hook 1211 onto loop 1221, or onto any other loop on adjustment element 1220. Similarly, loop 1221, and any other loop on adjustment element 1220, can securely sheath hook 1211 when inserted by users, and can prevent hook 1211 from becoming unintentionally unsheathed such that the adjusted fit is retained even when brace 1000 is not in use.

In a different embodiment, adjustment mechanism 1200 can comprise a snap-button mechanism that includes a snap-button stud coupled to a first region of brace body 1100, and a snap-button socket coupled to a second region of brace body 1100. The snap-button mechanism can be designed to be easily engaged when the snap-button stud is inserted, or "snapped," into the snap-button socket by a user. When engaged, the snap-button stud is securely grasped by the snap-button socket to prevent unintentional dislodgement and to retain the adjusted fit when the brace is not in use. Similarly, the snap-button mechanism can be designed to be easily disengaged when the snap-button stud is removed out of the snap-button socket by the user.

In another embodiment, adjustment mechanism 1200 can comprise a slide-button mechanism that includes a button coupled to a region of brace body 1100, and an buttonhole coupled to a second region of brace body 1100. The slide-button mechanism can be designed to be easily engaged when the button is slid into the buttonhole by a user. When engaged, the button is securely held in place by the buttonhole to prevent unintentional dislodgement and to retain the adjusted fit when the brace is not in use. Similarly, the slide-button mechanism can be designed to be easily disengaged when the button is removed from the buttonhole by the user.

In some embodiments, adjustment mechanism 1200 can comprise a mechanism that includes a multi-hook material attached to a first region of brace body 1100, and a multi-loop material attached to a second region of brace body 1100. In one example, the multi-loop and multi-hook materials can comprise hook and loop fasteners manufactured by Velcro USA, Inc., from Manchester, N.H. In some examples, a mechanism comprising multi-hook and multi-loop material can be referred to as a Velcro®-type mechanism.

In a different embodiment, adjustment mechanism 1200 can comprise a magnetic mechanism that includes a first magnetic element coupled to a first region of brace body 1100, and a second magnetic element coupled to a second region of brace body 1100. The magnetic mechanism can be designed to be easily engaged when the first and second magnetic elements are brought towards each other and coupled together via magnetic attraction. In one example, each of the first and second magnetic elements comprises a magnet. In a different embodiment, the first magnetic element comprises a magnet, and the second magnetic element comprises a magnetic metal such as iron or steel. When the first and second magnetic elements are engaged, the magnetic attraction prevents unintentional dislodgement of the first and second magnetic elements to retain the adjusted fit when the brace is not in use. Similarly, the magnetic mechanism can be designed to be easily disengaged when the first and second magnetic elements are pulled apart from each other.

Brace 1000 also incorporates locking mechanism 1300. Locking mechanism 1300 can allow users to easily and swiftly configure or alternate brace 1000 from a bracing fit to a relaxed fit, and vice versa. The bracing fit can be engaged by conforming locking mechanism 1300 to a locked state for configuring brace 1000 to a tighter fitting, and is normally meant to securely hold brace 1000 to the usage position while worn. Conversely, the relaxed fit can be engaged by conforming locking mechanism to an unlocked state for configuring brace 1000 to a looser fitting, and is normally meant to allow users to easily position or remove brace 1000 towards or away from the desired usage position. As a result, relaxed fit measurements and dimensions tend to be larger and looser than bracing fit measurements for brace 1000.

In the present embodiment, locking mechanism 1300 includes a clamp assembly having clamp tab 1310 coupled to clamp tab 1320 via hinge 1330. In some embodiments, clamp tab 1310 can be referred to as a bottom clamp tab, and clamp tab 1312 can be referred to as a top clamp tab. Locking mechanism 1300 can be coupled to brace body 1000 through brace band 1110 via clamp tab 1320, and through brace band 1120 via clamp tab 1310 and around hinge 1330. In a different embodiment, where brace body 1100 comprises a single brace band, brace body 1100 can be routed through locking mechanism 1300 in an "S" shape fashion, entering through clamp tab 1310 and exiting through clamp tab 1320, or vice versa.

Locking mechanism 1300 can be designed to permit a hinging movement of clamp tab 1310 or clamp tab 1320, via hinge 1330, to occur away from and opposite to an interface surface at the usage position. Such a design may prevent pinching or other harms, and can make locking mechanism 1300 more comfortable to engage or disengage. In some examples, the interface surface can comprise the skin or clothes of users. Upon the hinging of locking mechanism 1300, two or more sections of brace body 11000 would overlap to configure brace 1000 for the bracing fit, as described in more detail below.

In the present example, clamp tab 1320 includes a clamp stub 1321, and clamp tab 1310 includes a clamp slot 1311. In some embodiments, clamp stub 1321 clamp tab slot 1311 can be referred to as locking elements. Clamp stub 1321 is designed to be firmly latchable by users into clamp slot 1311 when clamp tab 1310 and clamp tab 1320 are brought together or mated through the hinging action of hinge 1330. In the present example, clamp stub 1321 and clamp slot 1311 are substantially equidistant from hinge 1330. Clamp stub 1321 is also designed to be easily unlatchable by users from clamp slot 1311 when clamp tab 1310 is separated from clamp tab 1320 through the hinging action of hinge 1330. The latching and unlatching of clamp stub 1321 with clamp slot 1311 controls the fitting of brace 1000. Locking mechanism 1300 is conformed to the locked state when clamp stub 1321 and clamp slot 1311 are latched or locked together, thereby configuring brace 1000 for the bracing fit. Similarly, when clamp stub 1321 is unlatched from clamp slot 1311, locking mechanism 1300 engages brace 1000 into the relaxed fit.

In another embodiment, locking mechanism 1300 may comprise a single-tab clamp assembly that comprises a single clamp tab with a first locking element, and a second locking element coupled directly to a part of brace body 1100. In such an example, the single clamp tab can be similar to clamp tab 1320, but may hinge over brace body 1100 to couple directly to the second locking element at brace body 1100.

In some embodiments, locking mechanism 1300 and/or adjustment mechanism 1200 can be ergonomically tailored to fit the desired usage position. In one example, clamp tab 1310 can be curved, being concave or convex as needed with respect to the skin of users. In the same or a different example, clamp tab 1320 can be similarly curved. In the same or a different example, the ergonomic tailoring of locking mechanism 1300 can be based on standard anatomical data of average users for desired usage positions, such as the average size of upper arms, biceps, or forearms, among others.

In a different embodiment, locking mechanism 1300 can comprise a snap-button mechanism that includes locking elements such as a snap-button stud coupled to a first region of brace 1000, and a snap-button socket coupled to a second region of brace 1000. In one example, the snap-button stud is coupled to one of clamp tabs 1310 or 1320, and the snap-button socket is coupled to the other one of clamp tabs 1310 or 1320. In embodiments comprising a single-tab clamp assembly, locking mechanism 1300 can include the snap-button stud coupled to clamp tab 1320, and the snap-button socket coupled to brace band 1120. Other combinations and permutations of clamp tabs 1310 and 1320 with the snap-button stud and the snap-button socket are possible.

In a another embodiment, locking mechanism 1300 can comprise a slide-button mechanism that includes a button coupled to a first region of brace 1000, and a buttonhole coupled to a second region of brace 1000. In one example, the button is coupled to one of clamp tabs 1310 or 1320, and the buttonhole is coupled to the other one of clamp tabs 1310 or 1320. In embodiments comprising a single-tab clamp assembly, locking mechanism 1300 can include the button coupled to clamp tab 1320, and the buttonhole coupled to brace band 1120. Other combinations and permutations of clamp tabs 1310 and 1320 with of the button and buttonhole are possible.

In a further embodiment, locking mechanism 1300 can comprise a Velcro®-type mechanism, including multi-hook material coupled to a first region of brace 1000, and multi-loop material coupled to a second region of brace 1000.

In one example, the multi-hook material is coupled to one of clamp tabs 1310 or 1320, and the multi-loop material is coupled to the other one of clamp tabs 1310 or 1320. In embodiments comprising a single-tab clamp assembly, locking mechanism 1300 can include the multi-hook material coupled to clamp tab 1320, and the multi-loop material coupled to brace band 1120. Other combinations and permutations of clamp tabs 1310 and 1320 with the multi-hook material and the multi-hook material possible.

In another example, locking mechanism 1300 can comprise a magnetic mechanism that includes locking elements such as a first magnetic element coupled to a first region of brace 1000, and a second magnetic element coupled to a second region of brace 1000. The first and second magnetic elements could each comprise a magnet. Alternatively, the first magnetic element could comprise a magnet while the second magnetic element could comprise a magnetic metal. In one example, the first magnetic element is coupled to one of clamp tabs 1310 or 1320, and the second magnetic element is coupled to the other one of clamp tabs 1310 or 1320. In embodiments comprising a single-tab clamp assembly, locking mechanism 1300 can include the first magnetic element coupled to clamp tab 1320, and the second magnetic element coupled to brace band 1120. Other combinations and permutations of clamp tabs 1310 and 1320 with the first and second magnetic elements are possible.

In some embodiments, locking mechanism 1300 can also include a skin-protective exterior. In the present embodiment, locking mechanism 1300 uses the skin-protective exterior 1130 of brace band 1120 as routed under clamp tab 1310, thus minimizing skin contact with locking mechanism 1300. In other embodiments, locking mechanism 1300 can have its own skin protective exterior attached to it, instead of or in addition to relying upon the skin protective exterior 1130 of brace body 1100. In other examples, the exterior surface of locking mechanism 1300 can comprise a skin-protective exterior such that locking mechanism 1300 is made of skin-friendly material In the same or a different example, where brace 1000 comprises a skin-protective exterior, the skin or clothes of users at the interface surface can be protected from pinching, tearing, or other harms by preventing direct contact between the skin or clothes and parts of brace 1000 that may be sharper, rougher, or moveable. In the present embodiment, the skin protective exterior 1130 on brace band 1120 covers hinge 1330 on locking mechanism 1300, thus preventing hinge 1330 from contacting or pinching the skin or clothes of users when locking mechanism 1300 is moved from the open to the closed positions, and vice versa. In addition, in the present example, skin protective exterior 1130 prevents most other areas of brace 1000 from directly contacting skin or clothes of users altogether, thus adding a safety and comfort margin against harm to skin or clothes due to any sharp, rough or uncomfortable edges while brace 1000 is worn.

In the same or a different example, locking mechanism 1300 can incorporate a curling formed on either or both of clamp tab 1310 or clamp tab 1320. The curling can be designed to elevate and distance the location of hinge 1330 from the interface surface, such as to further minimize any possibility for pinching or harm due to contact with the hinging action of hinge 1330. A more detailed example of the curling is further described below with reference to FIGS. 5-7.

Brace 1000 can include wielding mechanism 1400. Wielding mechanism 1400 allows users to attach portable devices to brace 1000, and is capable of securely wielding portable devices when brace 1000 is in use. Portable devices that can be wielded by the brace 1000 can include mechanical devices and electrical devices such as, for example, cellular telephones, personal digital assistants (PDAs), and portable digital music players, including MP3 players such as those sold under the trademark iPod® by Apple Computer, Inc. of Cupertino, Calif. In the present example, wielding mechanism 1400 is coupled to brace band 1110 of brace body 1100. Other examples may comprise similar wielding mechanisms coupled to locking mechanism 1300 and/or adjustment mechanism 1200.

In the present illustration, wielding mechanism 1400 is coupled to brace body 1100, and includes a wielding loop 1410 capable of securely sheathing, for example, standard clip-on tabs commonly found on many portable devices. In a different embodiment, wielding mechanism 1400 can comprise brace body 1100 itself, for example, when standard clip-on tabs of portable devices are slid over any region of brace body 1100. In other examples, wielding mechanism 1400 can be attached instead to locking mechanism 1300 and/or to adjustment mechanism 1200. In some embodiments, wielding mechanism 1400 can comprise a snap-button mechanism, a slide-button mechanism, a magnetic mechanism, or a Velcro®-type mechanism, among other arrangements.

Figure 6:
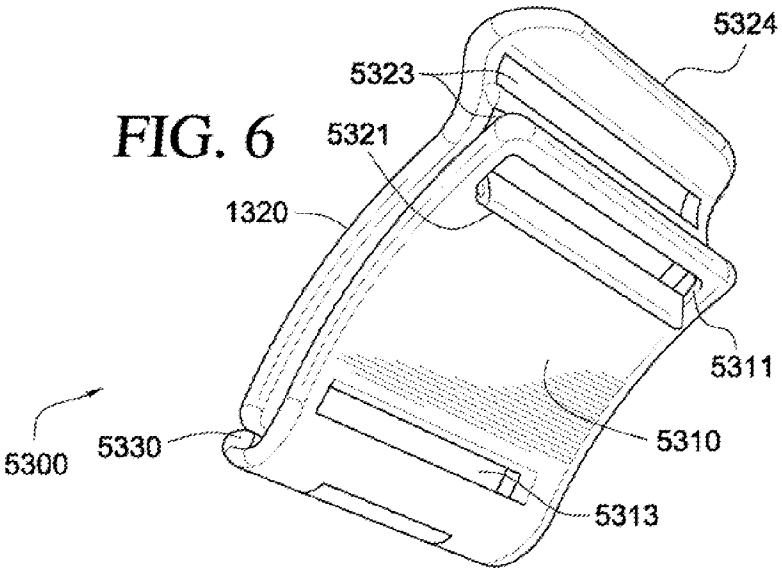
FIG. 6 illustrates the locking mechanism of FIG. 5 in a closed or locked state.
Figure 5:
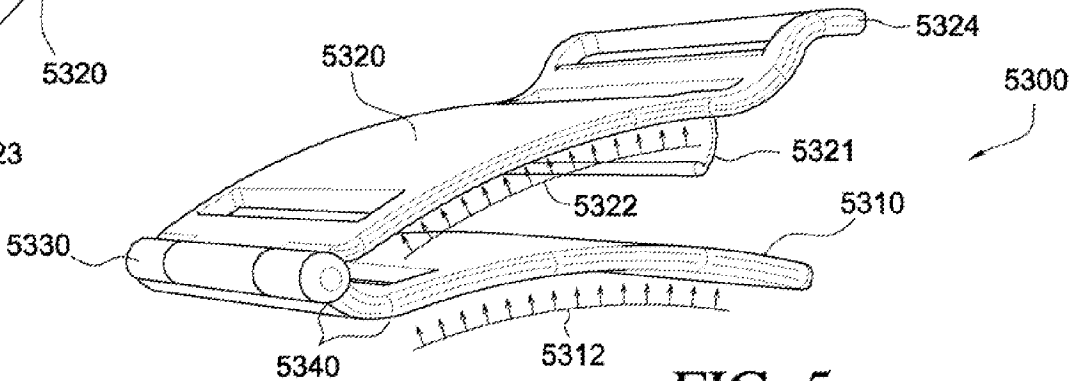
FIG. 5 illustrates an isometric view of a locking mechanism according to a second embodiment of a brace.
Figure 7:
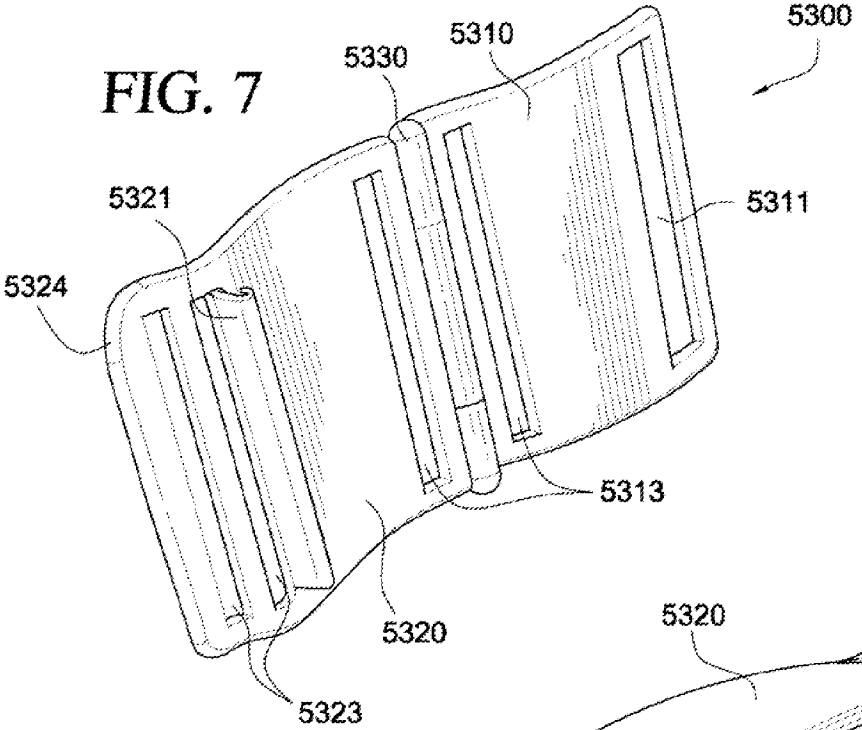
FIG. 7 illustrates the locking mechanism of FIG. 5 in a fully open and unlocked state.

FIGS. 5, 6, and 7 illustrate different isometric views of locking mechanism 5300, which is similar to locking mechanism 1300 in FIGS. 1-4. In particular, FIG. 6 illustrates locking mechanism 5300 in a closed or locked state, while FIG. 7 illustrates locking mechanism 5300 in a fully open and unlocked state.

In the present embodiment, locking mechanism 5300 comprises clamp tab 5312, hingedly attached via hinge 5330 to clamp tab 5320. In particular, FIG. 5 illustrates clamp tab 5310 featuring ergonomic tailoring 5312. In the same or a different embodiment, ergonomic tailoring 5312 can be designed to make locking mechanism 5300 more comfortable to wear at the desired usage position. In one example, ergonomic tailoring 5312 for clamp tab 5310 can be curved, being concave or convex as needed with respect to the skin of users. In the same or a different embodiment, an ergonomic tailoring 5322 can be implemented into clamp tab 5320, for example, following the same methodology and for the same comfort considerations of ergonomic tailoring 5312, or to otherwise make clamp tab 5320 easier to operate. In the same or a different example, ergonomic tailoring 5312 and/or ergonomic tailoring 5322 of locking mechanism 5300 can be based on standard anatomical data of average users for desired usage positions, such as the average size of user upper arms, biceps, or forearms, among others.

In the present embodiment, locking mechanism 5300 includes curling 5340 on clamp tab 5310. Curling 5340 is meant to protect the skin and/or clothes of users from pinching and other related harms by spacing apart or raising hinge 5330 up and away from the side of locking mechanism 5300 most likely to be in contact with an interface surface when worn. In other embodiments, clamp tab 5320 could feature its own curling similar to curling 5340.

In the illustrated example, locking mechanism 5300 includes a clamp handle 5324 on clamp tab 5320. Clamp handle 5324 can be designed to assist in latching locking mechanism 5300 by providing users with better leverage to facilitate insertion of a clamp stub 5321 into a clamp slot 5311. Similarly, clamp handle 5324 can be designed to assist in unlatching locking mechanism 5300, providing users better grip to facilitate removal of clamp stub 5321 from clamp slot 5311.

Locking mechanism 5300 is designed in the present example to allow a brace to be configured into or out of position by a user. In some examples, the brace can be similar to brace 1000 in FIGS. 1-4. Locking mechanism 5300 includes brace band slot set 5323 on clamp tab 5320, designed to allow the attachment of a first portion of a brace band to locking mechanism 5300. In some embodiments, the brace band can comprise either a single brace band strip or a plurality of brace band strips coupled together. As locking mechanism 5300 is latched by inserting clamp stub 5321 into clamp slot 5311, clamp tab 5320 pulls the first portion of the brace band along towards clamp tab 5310, thus configuring the brace for a bracing fit similar to the bracing fit described for brace 1000 in FIGS. 1-4. When locking mechanism 5300 is unlatched by removing clamp stub 5321 from clamp slot 5311, clamp tab 5320 pulls the first portion of the brace band away from clamp tab 5310, thus configuring brace 5000 for a relaxed fit similar to the relaxed fit described for brace 1000 in FIGS. 1-4.

In the present example, locking mechanism 5300 also includes a brace band slot set 5313 divided between clamp tabs 5310 and 5320. In other embodiments, brace band slot set 5313 can be fully contained in clamp tab 5310 or clamp tab 5320. Brace band slot set 5313 is designed to allow the attachment of a second portion of the brace band to locking mechanism 5300. In the present embodiment, the second portion of the brace band attaches around brace band slot set 5313, thus covering hinge 5330 and other areas of locking mechanism 5300 likely to come into contact with the skin or clothes of users. In other embodiments, the attachment of the second brace band around brace band slot set 5313 may not necessarily prevent hinge 5330 or other parts of locking mechanism 5300 from contacting skin or clothes of users.

FIGS. 8-11 illustrate multiple isometric views of brace 8000 in a different embodiment of brace 1000 (FIGS. 1-4). Brace 8000 includes brace body 8100, which can be similar to brace body 1100 of FIGS. 1-4. Brace 8000 also includes adjustment mechanism 8200, similar to adjustment mechanism 1200 in FIGS. 1-4. In addition, brace 8000 further includes locking mechanism 8300, similar to locking mechanisms 1300 (FIGS. 1-4) and 5300 in (FIGS. 5-7).

Different modes of operation that a user might follow when using brace 8000 can be ascertained by referencing the different configurations shown in FIGS. 8-11 for brace 8000. References to usage modes, such as adjusted fit, relaxed fit, and bracing fit, relate to similar operating or usage configurations as described for FIGS. 1-7.

Figure 8:
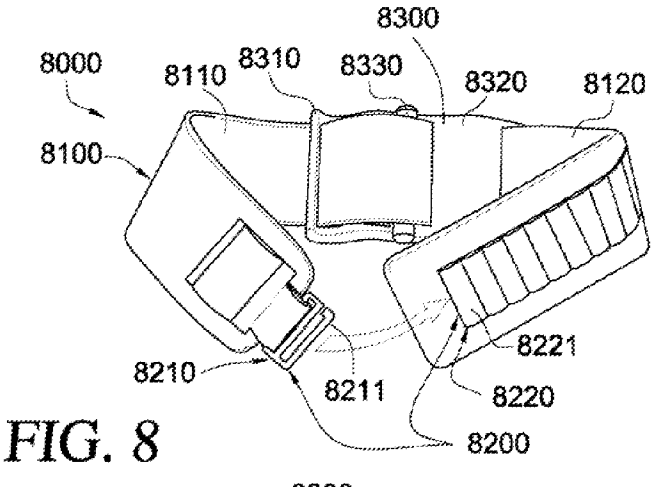
FIG. 8 illustrates an isometric view of a second brace in an unadjusted and unlatched state, according to a third embodiment.

FIG. 8 illustrates an isometric view of brace 8000 in an unadjusted and unlatched state, and indicates with an arrow a direction for moving adjustment mechanism 8200 to configure brace 8000 to an adjusted fit.

Brace 8000 comprises a brace body 8100 including brace band 8110 and a brace band 8120, both coupled together via a locking mechanism 8300. Locking mechanism 8300 comprises a clamp tab 8310 and a clamp tab 8320, both hingedly coupled together via a hinge 8330. Brace band 8120 attaches to locking mechanism 8300 via clamp tab 8320, while brace band 8110 attaches to locking mechanism 8300 by passing through clamp tab 8310 and wrapping around hinge 8330. Brace 8000 further comprises adjustment mechanism 8200. Adjustment mechanism 8200 includes an adjustment assembly 8210 including at least a hook 8211 on brace band 8110, and an adjustment assembly 8220 including at least a loop 8221 on brace band 8120. Loop 8221 is designed to securely sheath hook 8211, once inserted by a user, and to prevent hook 8211 from becoming unintentionally unsheathed.

Brace 8000 can be configured to an adjusted fit, similar to the adjusted fit described for brace 1000 in FIGS. 1-4. In order to configure brace 8000 to an adjusted fit, a user can first latch locking mechanism 8300 by bringing together clamp tab 8320 and clamp tab 8310 through the hinging action of hinge 8330. Brace 8000 can then be wrapped around a desired usage position on the user's body, and can then be configured to an adjusted fit via adjustment mechanism 8200 by sheathing hook 8211 onto, for example, loop 8221. Once custom-set by the user, the adjusted fit can be retained for brace 8000, even while not being worn, via the sheathing action of adjustment mechanism 8200. Adjustment mechanism 8200 thus prevents the user from having to re-configure brace 8000 to a custom adjusted fit each time it is used.

Figure 9:
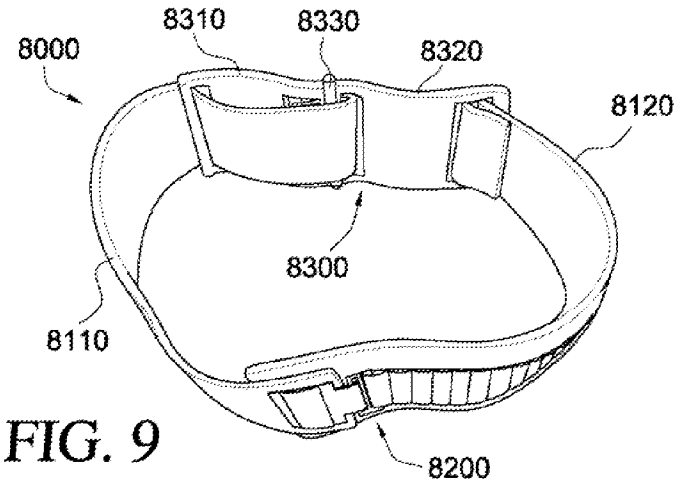
FIG. 9 illustrates an isometric view of the brace of FIG. 8 in an adjusted state and configured for a relaxed fit.

FIG. 9 illustrates an isometric view of brace 8000 in an adjusted state and configured for a relaxed fit. The relaxed fit can be similar to the relaxed fit described for brace 1000 in FIGS. 1-4. Locking mechanism 8300 is shown unlatched and fully open, separating brace band 8120 away from clamp tab 8310, thus configuring brace 8000 for a relaxed fit such that a user can more easily slide brace 8000 into or out of a desired usage position. In addition, adjustment mechanism 8200 is shown preserving the adjusted fit, with loop 8221 securely sheathing hook 8211, even while brace 8000 is not in use.

Figure 10:
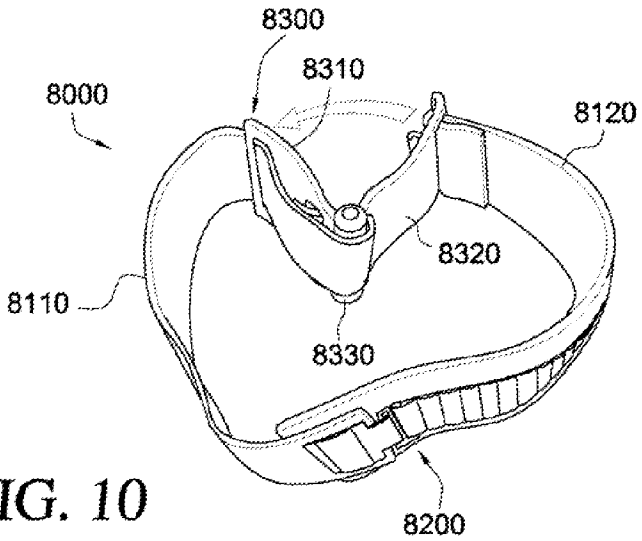
FIG. 10 illustrates an isometric view of the brace of FIG. 8 in the adjusted state, where an arrow indicates a motion to configure the brace from the relaxed fit to a bracing fit.

FIG. 10 illustrates an isometric view of brace 8000 in an adjusted state, and indicates with an arrow a motion for moving locking mechanism 8300 to configure brace 8000 from a relaxed fit to a bracing fit. The bracing fit can be similar to the bracing fit described for brace 1000 in FIGS. 1-4. After having set the adjusted fit for brace 8000 as described for FIG. 8, the user can position brace 8000 onto the desired usage position while brace 8000 remains configured for the relaxed fit as shown in FIG. 9. The user can then easily engage the bracing fit for brace 8000 by latching locking mechanism 8300 via the hinging action of hinge 8330. The latching of locking mechanism 8300 pulls brace band 8120 along towards clamp tab 8310, thus configuring brace 8000 for the bracing fit by decreasing its diameter. Once configured for bracing fit, the measurements of brace 8000 automatically match the custom previously-set adjusted fit measurements, as retained by adjustment mechanism 8200.

Figure 11:
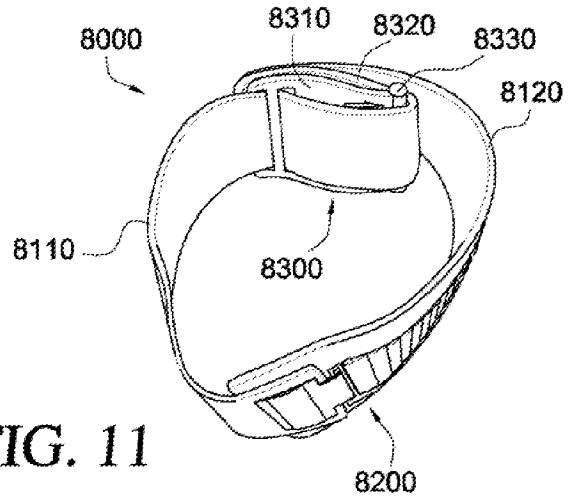
FIG. 11 illustrates an isometric view of the brace of FIG. 8 in the adjusted state, and configured for the bracing fit.

FIG. 11 illustrates an isometric view of brace 8000 in an adjusted state, and configured for the bracing fit. Locking mechanism 8300 is shown latched and fully closed, pulling brace band 8120 towards clamp tab 8310, and thus configuring brace 8000 for the custom adjusted fit measurements previously set by the user. When engaged, the bracing fit will securely hold brace 8000 to the desired usage position on the user's body, allowing the user to easily carry any portable devices attachable to brace 8000.

Figure 12:
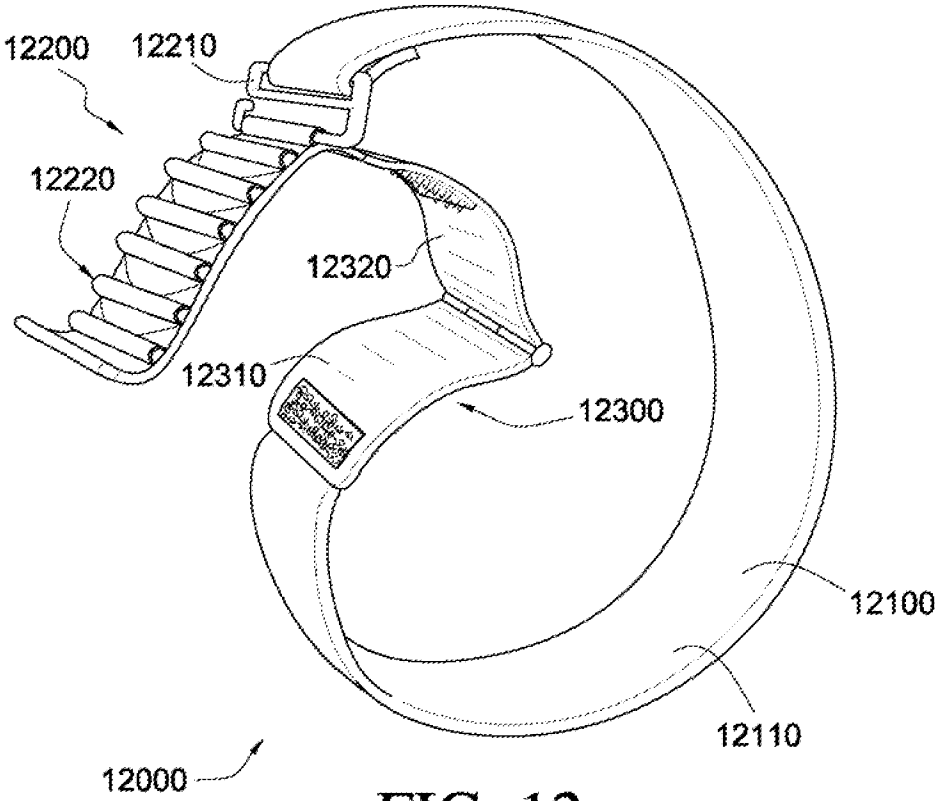
FIG. 12 illustrates an isometric view of a third brace according to a fourth embodiment.

FIG. 12 illustrates an isometric view of a brace 12000, which can be similar to brace 1000 (FIGS. 1-4), the brace described for FIGS. 5-7, and brace 8000 (FIGS. 8-11). Brace 12000 comprises brace body 12100, adjustment mechanism 12200, and locking mechanism 12300.

Brace 12000 can differ from the embodiment of FIG. 1 in that brace body 12100 comprises a single brace band 12110, instead of both brace band 1110 and brace band 1120 as in brace body 1100 (FIGS. 1-4). In the present embodiment, adjustment assembly 12220 is coupled to clamp tab 12320, instead of to brace body 12100, in contrast to the coupling shown in FIG. 1 for adjustment assembly 1220. Finally, locking mechanism 12300 comprises a complementary hook and loop latching mechanism, in contrast to the clamp stub and slot mechanism of the embodiment in FIG. 1.

In the present embodiment, adjustment assembly 12220 can serve a double purpose. Firstly, adjustment assembly 12220 can act as part of adjustment mechanism 12200, keeping brace 12000 in an adjusted fit by holding adjustment assembly 12210 in place after brace 12000 has been adjusted by its user. Secondly, adjustment assembly 12220 can serve as a clamp handle, similar in function to clamp handle 5324 (FIGS. 5, 6, and 7), to provide better grip when latching or unlatching locking mechanism 12300. In the same or a different embodiment, adjustment assembly 12220 can be made of a severable material, able to be cut or otherwise shortened to size, after the user has configured brace 12000 to an adjusted fit.

Figure 15:
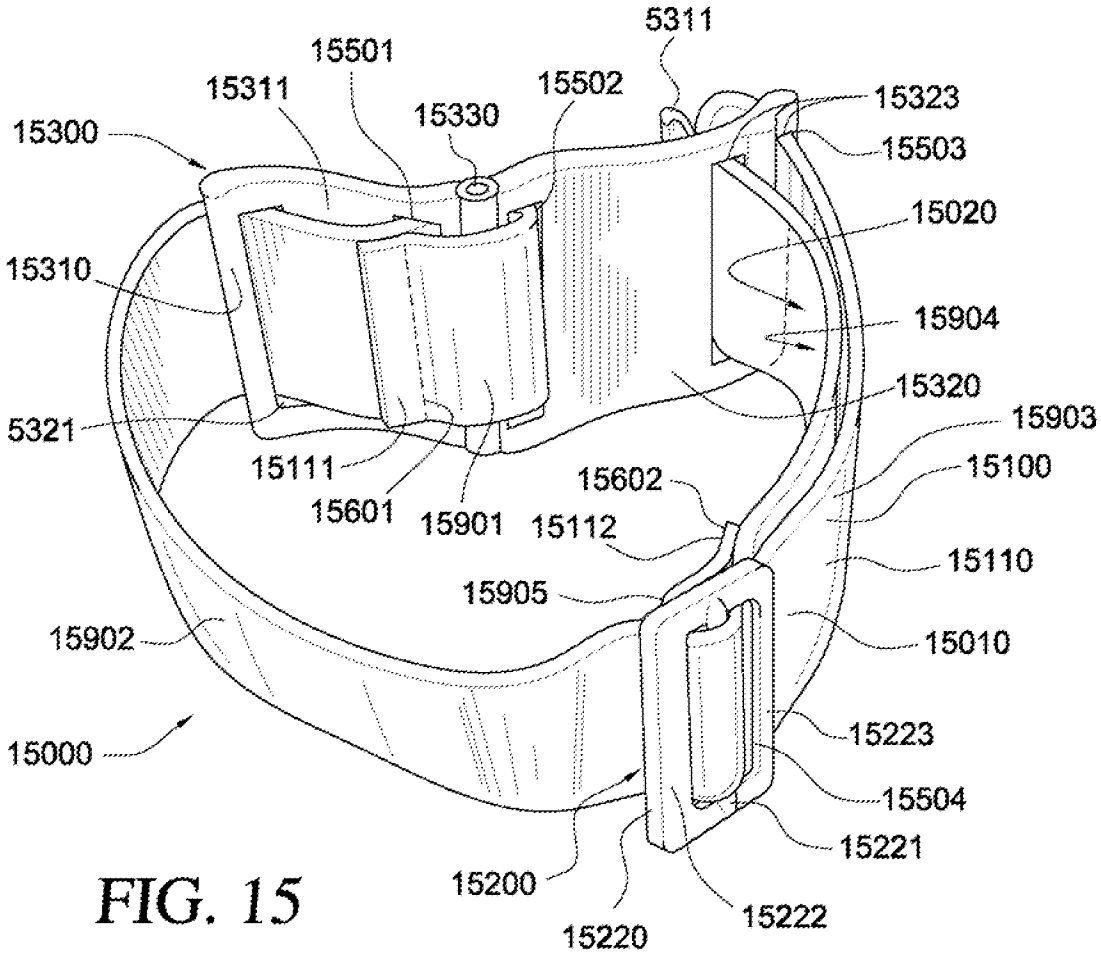
FIG. 15 illustrates an isometric view of another brace configured for a relaxed fit according to a seventh embodiment.
Figure 17:
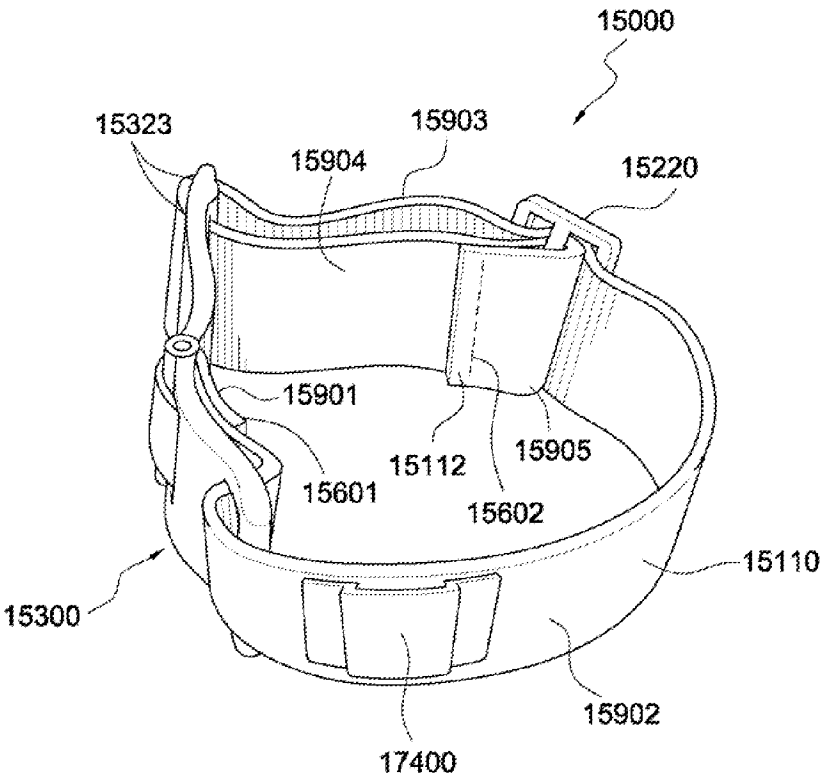
FIG. 17 illustrates a different isometric view of the brace of FIG. 15 configured for the relaxed fit.
Figure 16:
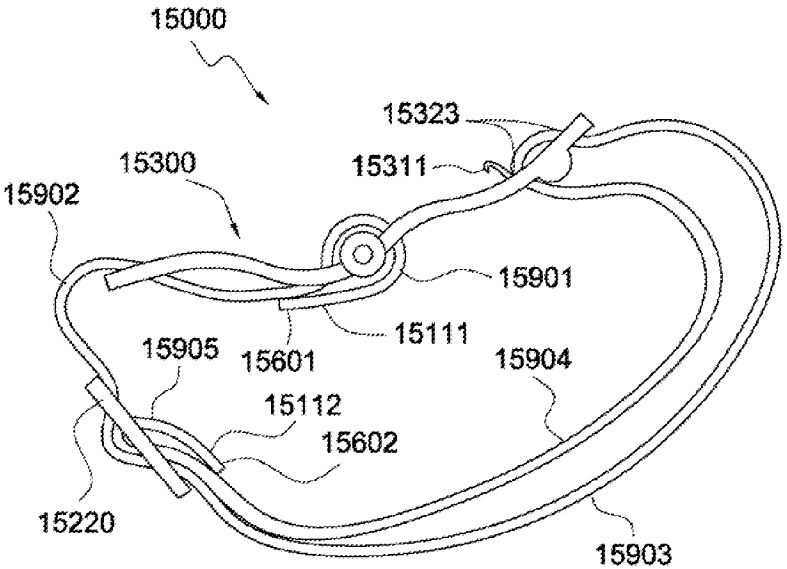
FIG. 16 illustrates another isometric view of the brace of FIG. 15 configured for the relaxed fit.
Figure 18:
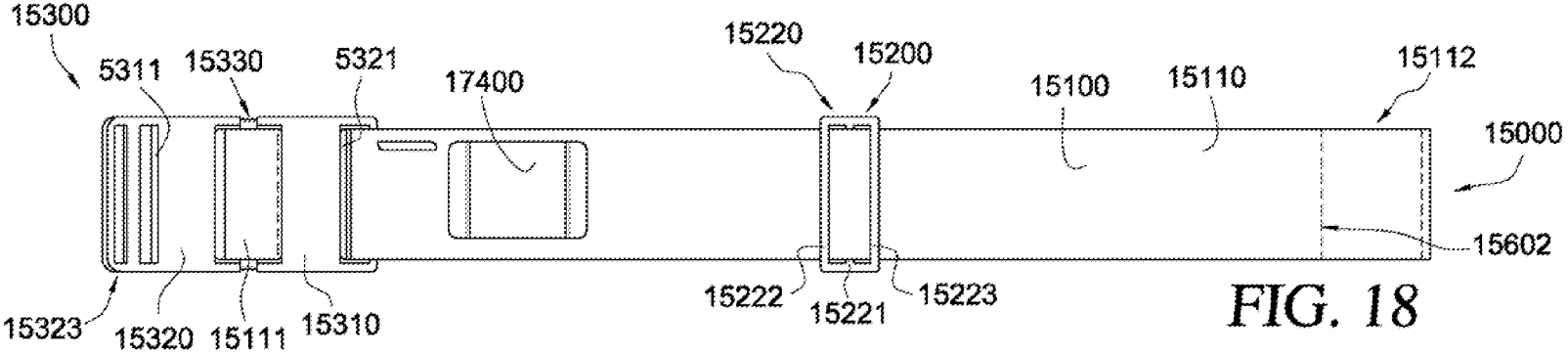
FIG. 18 illustrates a top view of the brace of FIG. 15 in a partially assembled configuration.
Figure 20:
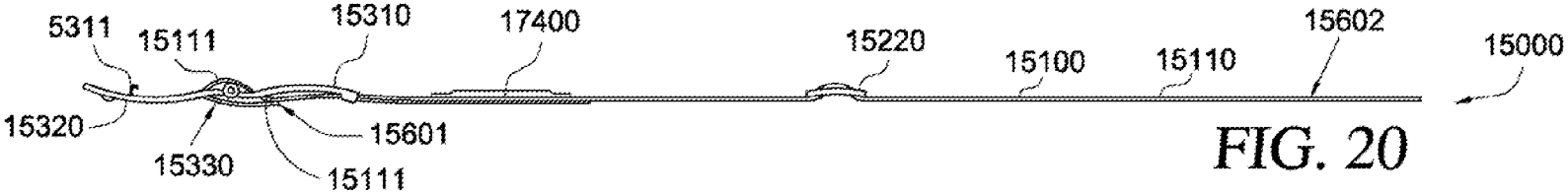
FIG. 20 illustrates a side view of the brace of FIG. 15 in the partially assembled configuration.
Figure 19:
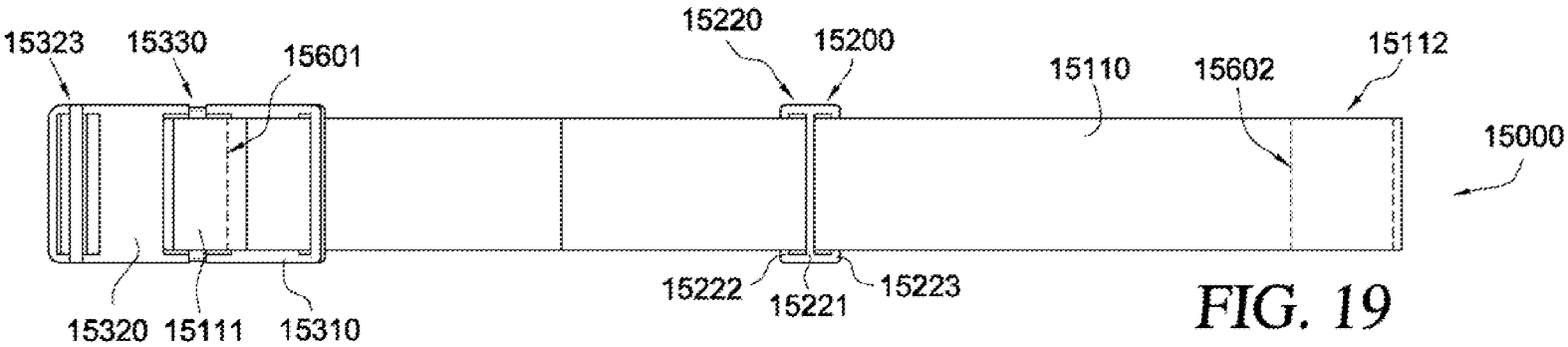
FIG. 19 illustrates a bottom view of the brace of FIG. 15 in the partially assembled configuration.
Figure 21:
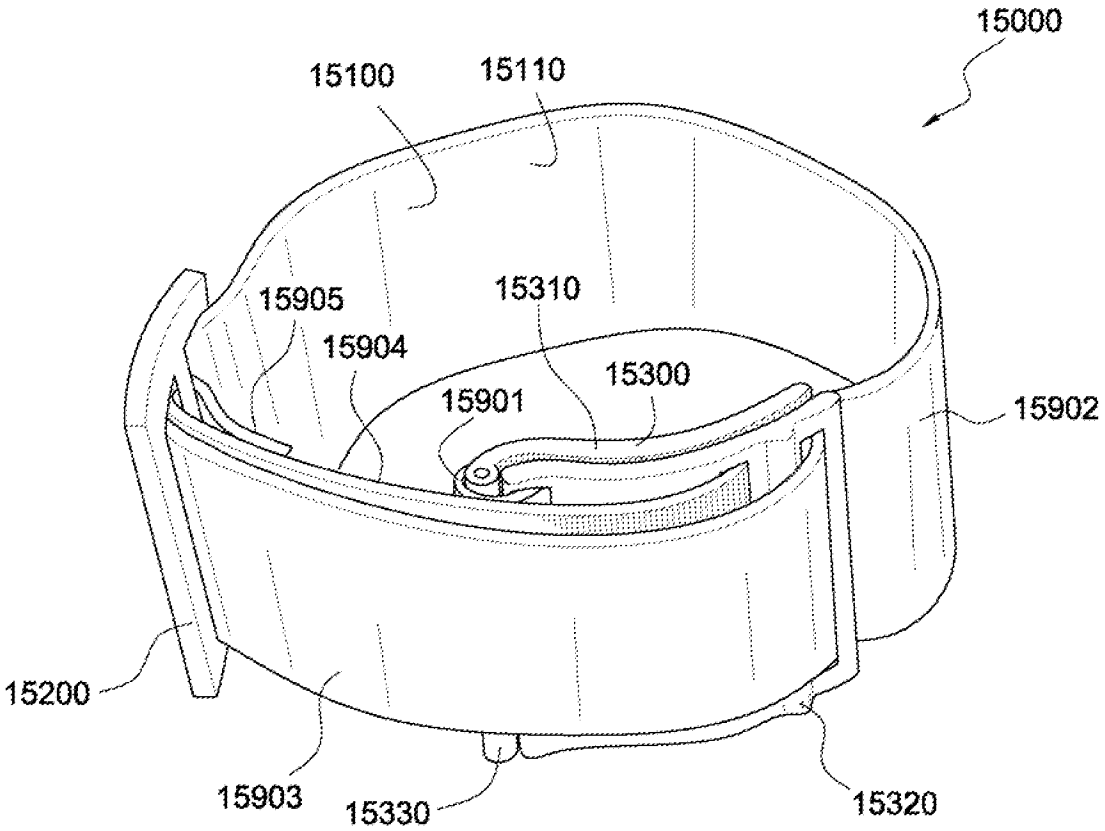
FIG. 21 illustrates the brace of FIG. 15 configured for a bracing fit.

Skipping ahead to FIGS. 15-21, multiple views of a brace 15000 are illustrated. Brace 15000 can be similar in many aspects to brace 1000 in FIGS. 1-4, the brace described for FIGS. 5-7, brace 8000 in FIGS. 8-11, and/or brace 12000 in FIG. 12, and can be configured for adjusted, relaxed, and bracing fits similar to those fits described above. Brace 15000 comprises brace body 15100, adjustment mechanism 15200, locking mechanism 15300, and wielding mechanism 17400. Locking mechanism 15300 could be described as a clamping mechanism in some examples. In the present example, locking mechanism 15300 comprises locking elements 5311 and 5321 (not shown in FIGS. 15-17), as described above for FIGS. 5-7. FIG. 15-17 illustrate brace 15000 configured for the relaxed fit. FIGS. 18-20 illustrate brace 15000 in a partially assembled configuration, with brace band 15110 not fully routed through adjustment mechanism 15200 and locking mechanism 15300. FIG. 21 illustrates brace 15000 configured for the bracing fit, with locking mechanism 15300 in a locked state. In the present example, locking mechanism 15300 is similar to locking mechanism 1300 in FIGS. 1-4, to locking mechanism 5300 in FIGS. 5-7, and to locking mechanism 8300 in FIGS. 8-11. In addition, wielding mechanism 17400 is similar to wielding mechanism 1400 in FIGS. 1-4. In some examples, brace 15000 could comprise a skin protective exterior at one or more of brace body 15100, adjustment mechanism 15200, locking mechanism 15300 and/or wielding mechanism 15400.

Brace 15000 differs from the embodiment of FIG. 1, for example, in that brace body 15100 comprises a single brace band 15110, instead of both brace band 1110 and brace band 1120 of brace body 1100 (FIGS. 1-4). In addition, adjustment mechanism 15200 includes a glider buckle mechanism, in contrast to the hook and loop adjustment mechanism 1200 of brace 1000 in FIGS. 1-4.

In the present embodiment, adjustment mechanism 15200 comprises glider buckle 15220 coupled to brace band 15110. Glider buckle 15220 comprises glider post 15221, glider leg 15222, and glider leg 15223, and is configured to slide along at least a portion of brace band 15110. Glider legs 15222 and 15223 can form part of a continuous periphery of glider buckle 15220, and need not be physically separated from each other. Brace band 15110 also comprises a first extreme 15111 and a second extreme 15112.

In the illustrated example, brace band 15110 is coupled to locking mechanism 15300 by routing first extreme 15111 along underside 15311 of clamp tab 15310 and around hinge 15330. The loop thus formed by first extreme 15111 around hinge 15330 is secured to region 15601 of brace band 15110 by stitching, gluing, or other suitable methods. Second extreme 15112 of brace band 15110 is routed through adjustment mechanism 15200, entering at one side of adjustment mechanism 15200 between glider leg 15222 and glider post 15221, continuing around glider post 15221, and exiting at the other side of adjustment mechanism 15200 between glider post 15221 and glider leg 15223. Brace band 15110 is then coupled to clamp tab 15320 by routing second extreme 15112 around brace band slot set 15323 of clamp tab 15320. The routing of brace band 15110 then continues back towards glider buckle 15220, where second extreme 15112 is looped around glider post 15221, and then secured to glider buckle 15220 at region 15602 of brace band 15110 by stitching, gluing, or other suitable methods.

Based on the routing of brace band 15110 as described above, brace band 15110 could be described in terms of the following portions. A portion 15901 of brace band 15110 can extend through slot 15502 of clamp tab 15310, to the top side of clamp tab 15320, around hinge 15330, and through slot 15501 back to underside 15311. The portion 15901 that extends through slot 15501 can couple to region 15601 of brace band 15110 proximate to slot 15501. Region 15601 can be part of portion 15901. A portion 15902 of brace band 15110 extends from portion 15901 and couples to adjustment mechanism 15200. A portion 15903 of brace band 15110 extends from portion 15902 and couples to slot 15503 of clamp tab 15320. A portion 15904 of brace band 15110 extends from portion 15903 and couples back to adjustment mechanism 15200. A portion 15905 of brace band 15110 extends from portion 15904, through slot 15504 of adjustment mechanism 15200, and couples to region 15602 of brace band 15110. Region 15602 can be part of portion 15905.

In the same or a different embodiment, adjustment mechanism 15200 can serve the same purposes as the adjustment mechanisms for the embodiments previously described, including adjustment mechanism 1200 in FIGS. 1-4. In that regard, adjustment mechanism 15200 can allow users to configure brace 15000 to an adjusted fit customized for a desired usage position.

The adjusted fit for brace 15000 can be configured by sliding the glider buckle of glider buckle 15220 along brace body 15100. Because portion 15905 of brace band 15110 is coupled to glider buckle 15220, any sliding of glider buckle 15220 inherently repositions portion 15905 as well along brace body 15100. As a result, the diameter of clamp brace 15000 can be decreased, to configure a smaller adjusted fit, by sliding glider buckle 15220 towards clamp tab 15310. This sliding inherently drags portion 15905 along brace body 15100, allowing more of brace band 15110 to be routed around brace band slot set 15323 into inner side 15020 of brace 15000. Similarly, the diameter of brace 15000 can be increased to configure a larger adjusted fit by sliding glider buckle 15220 towards clamp tab 15320. This sliding inherently drags portion 15905 along brace body 15100, allowing more of brace band 15110 to be routed around brace band slot set 15323 towards outer side 15010 of brace 15000.

After the adjusted fit has been established, brace 15000 can be configured to and from bracing and relaxed fits through locking mechanism 15300, as detailed for example for the previously described bracing and relaxed fits. The bracing fit could comprise locking elements 5311 and 5321 (FIGS. 5-7) coupled together, upon a rotation of clamp tabs 15310 and 15320 towards each other about hinge 15330, to overlap two or more sections of brace band 15110.

Regardless of their structural differences, all braces described herein can serve similar functions of securely and comfortably wielding portable devices in a hands-off manner, and of allowing users to easily engage or disengage the bracing fit with a single hand. It should be understood that these braces are merely exemplary, and are not limited to the presented embodiments. The functional aspects of the braces can also be employed in many different devices not specifically depicted or otherwise described herein.

Figure 13:
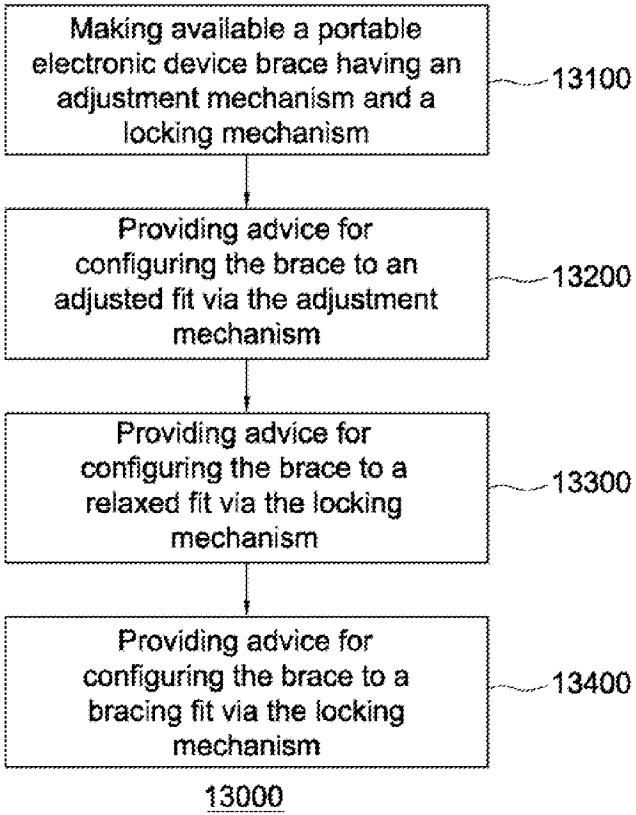
FIG. 13 illustrates a flowchart of a method for selling or marketing a brace according to a fifth embodiment.

Jumping back to FIG. 13, a flowchart of a method 13000 for selling or marketing a brace for portable electronic devices (i.e., a PED brace) is shown. Step 13100 forms part of method 13000, and involves making available a PED brace having an adjustment mechanism and a locking mechanism. The portable electronic devices that can be wielded by the PED brace could include, for example, cellular telephones, personal digital assistants (PDAs), and/or portable digital music players, including MP3 players such as those sold under the trademark iPod® by Apple Computer, Inc. of Cupertino, Calif. The PED brace can be any kind of attachment apparatus capable of affixing a portable electronic device to a user for comfortable hands-off portability. The PED brace can comprise, for example, an armband, a headband, a wristband, and anklebands, a belt, and similar devices.

The adjustment mechanism of the PED brace provided in step 13100 can incorporate, for example, a hook and loop arrangement, where a loop assembly on the PED brace can securely sheath a hook on a hook assembly. Alternatively, the adjusting mechanism can also incorporate other arrangements, such as button-down assemblies, magnetic assemblies, or complementary hook and loop material systems. The different types of adjustment mechanisms can retain the PED brace as configured, once adjusted by the user.

The locking mechanism of the PED brace provided in step 13100 can incorporate, for example, a clamp assembly, where clamp tabs can be closed or opened by the user to quickly configure the PED brace for different fits. In one example, one of the different fits can be used to secure the PED brace into a desired position, while another one of the different fits can be used to allow the PED brace to be easily positioned as desired. Alternatively, the locking mechanism can also incorporate other arrangements different from a clamp assembly, such as button-down assemblies, magnetic assemblies, or complementary hook and loop material systems.

In step 13100, the PED brace can be made available to purchasers or users, for example, by the manufacturer of the PED brace, distributors, marketers, or resellers. The PED brace can be made available at any point after manufacture, through marketing, or using wholesale distribution methods or retail networks that cater to midstream parties and end users.

In one example, the PED brace of step 13100 can be brace 1000 (FIGS. 1-4), the brace described for FIGS. 5-7, brace 8000 (FIGS. 8-11), brace 12000 (FIG. 12), and/or brace 15000 (FIGS. 15-21). In the same or a different example, the adjustment mechanism in step 13100 can be adjustment mechanism 1200 (FIGS. 1-4), the adjustment mechanism described for FIGS. 5-7, adjustment mechanism 8200 (FIGS. 8-11), adjustment mechanism 12200 (FIG. 12), and/or adjustment mechanism 15200 (FIGS. 15-21). In the same or a different example, the locking mechanism in step 13100 can be locking mechanism 1300 (FIGS. 1-4), locking mechanism 5300 (FIGS. 5-7), locking mechanism 8300 (FIGS. 8-11), locking mechanism 12300 (FIG. 12), and/or locking mechanism 15300 in FIGS. 15-21.

After step 13100, a step 13200 of method 13000 in FIG. 13 involves providing advice for configuring the PED brace to an adjusted fit via the adjustment mechanism introduced in step 13100. The adjusted fit can configure the PED brace to fit the user in a custom fashion while in use, and can be set by engaging the adjustment mechanism per the advice provided in step 13200. The advice in step 13200 can be offered to purchasers or users in general, and may be provided via different conduits such as through instruction sheets, commercials, advertisements, drawings, and other similar channels. As an example, the adjusted fit in step 13200 can be the adjusted fit described for brace 1000 in FIGS. 1-4, the adjusted fit for brace 8000 in FIGS. 8-11, the adjusted fit for brace 12000 in FIG. 12, and/or the adjusted fit for brace 15000 in FIGS. 15-21.

Subsequently, a step 13300 of method 13000 in FIG. 13 involves providing advice for configuring the PED brace to a relaxed fit via the locking mechanism introduced in step 13100. The relaxed fit can allow the user to easily maneuver or situate the PED brace to and/or from a desired usage position on the user, and can be set by positioning the locking mechanism per the advice provided in step 13300. The advice in step 13300 can be offered to purchasers or users in general, using the same conduits as described for step 13200. As an example, the relaxed fit in step 13300 can be the relaxed fit described for brace 1000 in FIGS. 1-4, the relaxed fit for brace 8000 in FIGS. 8-11, the relaxed fit for brace 12000 in FIG. 12, and/or the relaxed fit for brace 15000 in FIGS. 15-21.

Then, a step 13400 of method 13000 in FIG. 13 involves providing advice for configuring the PED brace to a bracing fit via the locking mechanism introduced in step 13100. The bracing fit can allow the user to securely brace the PED brace to the desired usage position on the user, and can be set by engaging the locking mechanism per the advice provided in step 13400. The advice in step 13400 can be offered to purchasers or users in general, using the same conduits as described for steps 13200 and 13300. As an example, the bracing fit in step 13400 can be the bracing fit described for brace 1000 in FIGS. 1-4, the bracing fit for brace 8000 in FIGS. 8-11, the bracing fit for brace 12000 in FIG. 12, and/or the bracing fit for brace 15000 in FIGS. 15-21.

In some examples, one or more of the different steps of method 13000 can be combined into a single step. For example, the advice of steps 13200, 13300, and/or 13400 could be provided on a single instruction sheet, thereby combining steps 13200, 13300, and 13400 into a single step. In the same or a different example, the sequence of one or more of the different steps of method 13000 can be changed. As an example, step 13400 could be performed before step 13300. In the same or a different example, method 13000 can comprise further or different steps consistent with marketing or selling a PED brace.

Figure 14:
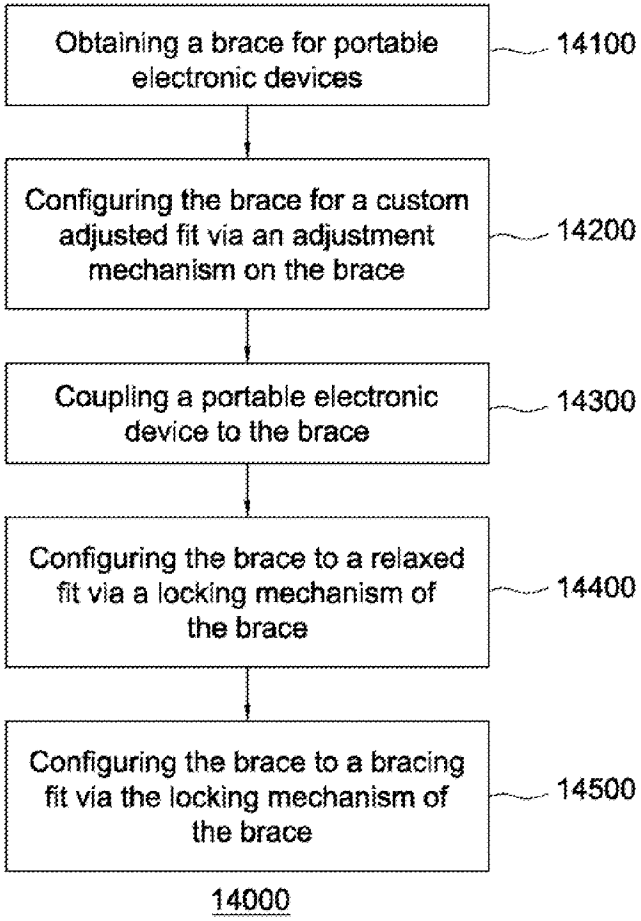
FIG. 14 illustrates a flowchart of a method for using a brace according to a sixth embodiment.

FIG. 14 illustrates a flowchart of a method 14000 for using a PED brace. A step 14100 of method 14000 in FIG. 14 involves obtaining the PED brace. As an example, the PED brace in method 14000 can be the brace described for method 13000 in FIG. 13, among others. Similarly, the portable electronic devices that can be wielded by the PED brace in method 14000 can be any of the portable electronic devices in method 13000 in FIG. 13, among others. In step 14100, the PED brace can be obtained by a user, for example, from a manufacturer, distributor, marketer, or reseller of the PED brace.

Next, a step 14200 of method 14000 in FIG. 14 involves configuring the PED brace for a custom adjusted fit via an adjustment mechanism on the brace. The adjustment mechanism and custom adjusted fit can be similar to those described for method 13000 in FIG. 13. The custom adjusted fit could be engaged for, and retained by, the PED brace via the adjustment mechanism.

In order to configure the PED brace for the custom adjusted fit, a user can first engage a locking mechanism of the brace into a locked state. The locking mechanism can be similar to the locking mechanism described for method 13000. The user can then wrap the PED brace around a desired usage position on the user's body. Once positioned, the custom adjusted fit can then be set by engaging the adjustment mechanism on the PED brace such that the PED brace will fit comfortably and securely around the desired usage position. The custom adjustment fit may be configured to be snug enough so that the brace can securely hold on to the desired usage position while wielding a portable electronic device that the user may couple to it.

After custom-set by the user, the adjustment mechanism can retain the custom adjusted fit for the PED brace, even while not being worn, thus preventing the user from having to re-configure the PED brace's custom adjusted fit each time it is used. Upon completion of the custom adjusted fit configuration, the user can remove the PED brace by disengaging the locking mechanism, and then sliding the PED brace off the desired usage position.

A step 14300 of method 14000 in FIG. 14 involves coupling a portable electronic device to the PED brace. A user can couple the portable electronic device to the PED brace, for example, via a wielding mechanism such as wielding mechanism 1400 described for FIGS. 1-4, or such as wielding mechanism 17400 of FIGS. 17-19. among others. In the same or a different example, where the portable electronic device comprises its own holding mechanism, such as a standard clip-on tab, the user may be able to couple the portable electronic device directly onto different regions of the PED brace.

A step 14400 of method 14000 in FIG. 14 comprises configuring the brace to a relaxed fit, via the locking mechanism on the brace. The relaxed fit can be similar to the relaxed fit described for method 13000 in FIG. 13. Whenever a user is wearing the PED brace, the user may remove the PED brace from the desired usage position by first configuring the PED brace to a relaxed fit. The relaxed fit can be configured for the PED brace by unlocking the locking mechanism. By configuring the PED brace to the relaxed fit, the user can more easily maneuver or position the PED brace relative to the desired usage position.

A step 14500 of method 14000 in FIG. 14 comprises configuring the brace to a bracing fit, via the locking mechanism of the brace, for attachment onto a desired usage position. The bracing fit can be similar to the bracing fit described for method 13000 in FIG. 13. After the custom adjusted fit has been set as described in step 14200, whenever a user decides to wear the PED brace, he can first configure the brace for a relaxed fit by unlocking the locking mechanism, if not already unlocked. Setting the locking mechanism to an unlocked state configures the PED brace to relaxed fit, allowing the user to more easily maneuver the PED brace to and from the desired usage position. After the user positions the PED brace as desired onto the desired usage position, the user can configure the PED brace for a bracing fit by locking the locking mechanism. The bracing fit allows the PED brace to fit comfortably and securely over the desired usage position, such that portable electronic devices can be attached and comfortably carried by the user in a hands-off manner.

In some examples, one or more of the different steps of method 14000 can be combined into a single step. In the same or a different example, the sequence of one or more of the different steps of method 14000 can be changed. As an example, steps 14300 can be performed before or after steps 14400 and/or 14500. In the same or a different example, method 14000 can comprise further or different steps, such as a step for removing the brace from the desired usage position after step 14500.

Figure 22:
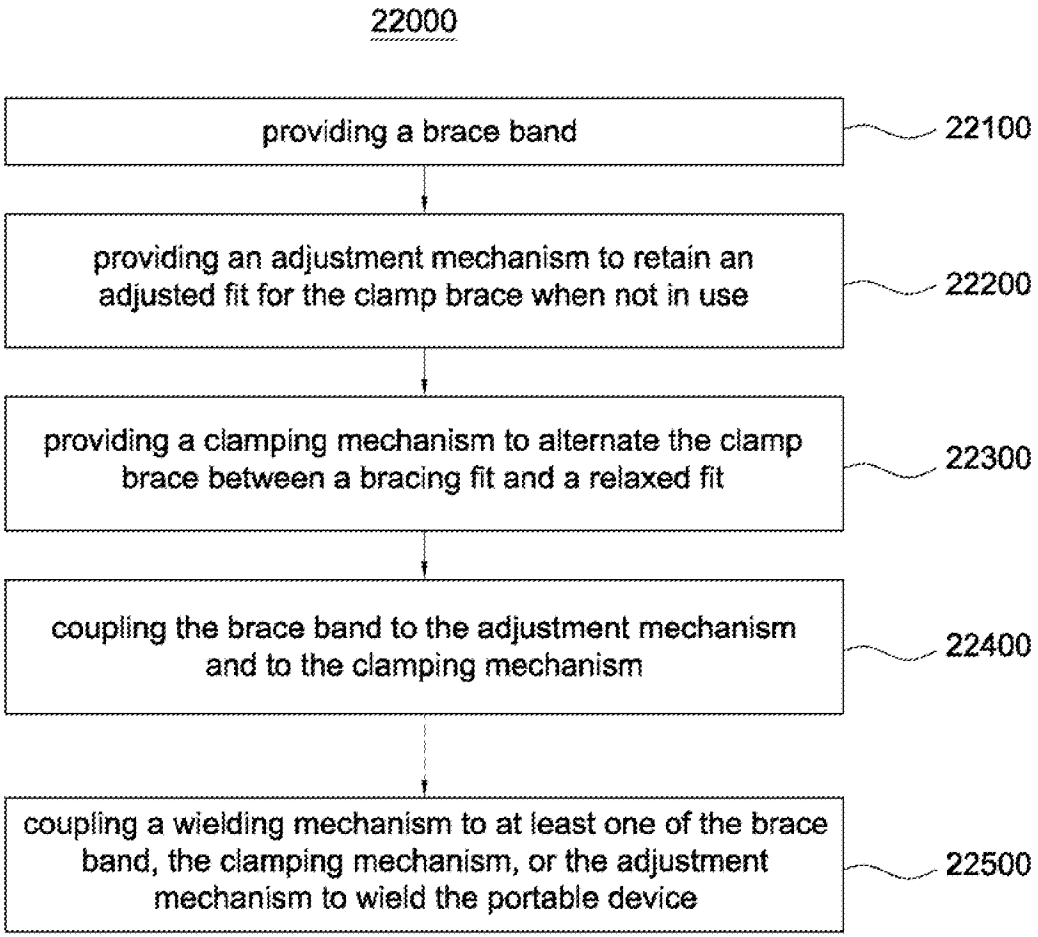
FIG. 22 illustrates a flowchart of method for manufacturing a brace according to an eighth embodiment.

Moving ahead through the figures, FIG. 22 illustrates a flowchart of a method 22000 for manufacturing a clamp brace for a portable device. In one example, the clamp brace of method 22000 can be similar to brace 1000 (FIGS. 1-4), the brace described for FIGS. 5-7, brace 8000 (FIGS. 8-11), brace 12000 (FIG. 12), and/or brace 15000 (FIGS. 15-21).

Step 22100 of method 22000 comprises providing a brace band for the clamp brace. In one example, the brace band can be similar to one or more of the brace bands of brace bodies 1100 (FIGS. 1-4), 8100 (FIGS. 8-11), 12100 (FIG. 12), and/or 15100 (FIGS. 15-21), such as brace band 12110 (FIG. 12), or brace band 15110 (FIGS. 15-12). In some examples, providing the brace band can comprise providing a skin protective exterior for the brace band, where the skin protective exterior can be coupled to, or an inherent characteristic of, the brace band.

Step 22200 of method 22000 comprises providing an adjustment mechanism to retain an adjusted fit for the clamp brace when not in use. In some examples, the adjustment mechanism can be similar to adjustment mechanism 1200 (FIGS. 1-4), the adjustment mechanism described for FIGS. 5-7, adjustment mechanism 8200 (FIGS. 8-11), adjustment mechanism 12200 (FIG. 12), and/or adjustment mechanism 15200 (FIGS. 15-21). The adjusted fit for the clamp brace can also be similar to the adjusted fit detailed above with respect to previously described braces.

Step 22300 of method 22000 comprises providing a clamping mechanism to alternate the clamp brace between a bracing fit and a relaxed fit. In some examples, the clamping mechanism of step 22300 can be similar to locking mechanism 1300 (FIGS. 1-4), locking mechanism 5300 (FIGS. 5-7), locking mechanism 8300 (FIGS. 8-11), locking mechanism 12300 (FIG. 12), and/or locking mechanism 15300 in FIGS. 15-21. The bracing and relaxed fits for the clamp brace of method 22000 can be similar to the bracing and relaxed fits described above with respect to previously described braces. For example, the bracing fit can be configured to brace the clamp brace of method 22000 at a usage position similar to the usage positions previously described. In addition, the relaxed fit can be configured to permit positioning of the clamp brace of method 22000 relative to the usage position. In some examples, providing the clamping mechanism can comprise providing a skin protective exterior for the clamping mechanism, where the skin protective exterior can be coupled to, or be an inherent characteristic of, the clamping mechanism.

The clamping mechanism of step 22300 can comprise a top clamp tab with a top locking element, a hinge coupled to the top clamp tab, and a bottom clamp tab with a bottom locking element and coupled to the hinge. In one example, the top and bottom clamp tabs, and/or the top and bottom locking elements, can be respectively similar to those described above for clamp tabs 1310 and 1320 (FIGS. 1-4), clamp tabs 5310 and 5320 (FIGS. 5-7), clamp tabs 8310 and 8320 (FIGS. 8-11), clamp tabs 12310 and 12320 (FIG. 12), and/or clamp tabs 15310 and 15320 (FIGS. 15-21). In addition, the hinge can be similar to hinges 1330 (FIGS. 1-4), 5330 (FIGS. 5-7), 8330 (FIGS. 8-11), and/or 15330 (FIGS. 15-21).

Step 22400 of method 22000 comprises coupling the brace band of step 22100 to the adjustment mechanism of step 22200 and to the clamping mechanism of step 22300. Upon completion of step 22400, the relaxed fit for the clamp brace of method 22000 can be configured to comprise the top and bottom locking elements of the clamp tabs of step 22300 disengaged from each other. In addition, the bracing fit for the clamp brace of method 22000 can be configured to comprise the top and bottom locking elements coupled together to overlap two or more sections of the brace band upon a rotation of the top and bottom clamp tabs towards each other about the hinge.

In one example, step 22400 can comprise several sub-steps to couple the brace band of step 22100 to the adjustment mechanism of step 22200 and to the clamping mechanism of step 22300.

A first sub-step of step 22400 can comprise coupling a first portion of the brace band through a first slot of the bottom clamp tab and back to a first region of the brace band proximate to the first slot of the bottom clamp tab. In the same or a different example, the first sub-step of step 22400 could comprise coupling the first portion of the brace band through a second slot of the top clamp tab and around the hinge. In some examples, this can be accomplished as illustrated for portion 15901 as routed around hinge 15330 in FIG. 15.

A second sub-step of step 22400 can comprise coupling a second portion of the brace band to the adjustment mechanism, where the second portion is adjacent to the first portion of the brace band. In one example, the second portion of the brace band can be coupled similar to portion 15902 of brace band 15100 (FIG. 15). In the same or a different example, the second sub-step of step 22400 can also comprise coupling a part of the second portion of the brace band to extend along an underside of the bottom clamp tab, from the first portion of the brace band to a second slot of the bottom clamp tab. This can be done, for example, as illustrated in FIG. 15 for the part of brace band 15100 along underside 15311 of clamp tab 15310.

A third sub-step of step 22400 can comprise coupling a third portion of the brace band through a first slot of the top clamp tab, where the third portion is adjacent to the second portion of the brace band. In one example, the third portion of the brace band can be coupled similar to portion 15903 of brace band 15100 (FIG. 15).

A fourth sub-step of step 22400 can comprise coupling a fourth portion of the brace band to the adjustment mechanism, where the fourth portion is adjacent to the third portion of the brace band. In one example, the fourth portion of the brace band can be coupled similar to portion 15904 of brace band 15100 (FIG. 15).

A fifth sub-step of step 22400 can comprise coupling a fifth portion of the brace band through a first slot of the adjustment mechanism and to a second region of the brace band proximate to the first slot of the adjustment mechanism. The fifth portion is adjacent to the fourth portion of the brace band. In one example, the fifth portion of the brace band can be coupled similar to portion 15905 of brace band 15100 (FIG. 15). In the present example, because the fifth portion of the brace band is coupled to the adjustment mechanism, the adjustment mechanism can be configured to reposition the fifth portion of the brace band along a length of the brace band to alter a diameter of the clamp brace of method 22000. This ability can be used, for example, to adjust the adjusted fit for the clamp brace of method 22000. In examples where the adjustment mechanism of step 22200 comprises a glider buckle, such as glider buckle 15220 (FIG. 15), the fifth portion of the brace band can comprise an end of the brace band fixedly attached around the glider post of the glider buckle. In addition, although described as different portions, the first, second, third, fourth, and fifth portions of the brace band of method 22000 need not be separate, and can be integral with and/or continuous along the brace band, where the brace band can comprise a single piece.

A step 22500 of method 22000 comprises coupling a wielding mechanism to at least one of the brace band, the clamping mechanism, or the adjustment mechanism to wield the portable device. In some examples, the wielding mechanism can be similar to wielding mechanism 1400 (FIGS. 1-4), wielding mechanism 17400 (FIGS. 17-18), or any other wielding mechanism described above. In the same or a different example, the brace band of step 22100 can serve as the wielding mechanism for the clamp brace of method 22000, for example, when a portable device has a clip that latches directly onto the brace band.

In some examples, one or more of the different steps of method 22000 can be combined into a single step. For example, the brace band of step 22100 may inherently comprise the wielding mechanism of step 22500, such that steps 22100 and 22500 could comprise a single step. In the same or a different example, the sequence of one or more of the different steps of method 22000 can be changed. As an example, the sequence of steps 22100, 22200, and 22300 could be interchanged without affecting the execution of method 22000. In the same or a different example, method 22000 can comprise further or different steps consistent with manufacturing a clamp brace.

Although the clamp braces and methods for manufacturing, selling, and using the same have been described with reference to specific embodiments, various changes may be made without departing from the spirit or scope of the disclosure herein. Various examples of such changes have been given in the foregoing description. As another example, although the fourth portion of brace band 15100 is shown at inner side 15020 of brace 15000 in FIG. 15, a different embodiment may comprise a fourth portion of brace band 15100 at outer side 15010 of brace band 15100. These and other modifications would not interfere with or depart from the concepts described herein.

Accordingly, the disclosure of embodiments of the clamp braces and methods for manufacturing, selling, and using the same is intended to be illustrative of the scope of the application and is not intended to be limiting. It is intended that the scope of this application shall be limited only to the extent required by the appended claims. For example, it will be readily apparent that the clamp braces and methods for manufacturing, selling, and using the same discussed herein may be implemented in a variety of embodiments, and that the foregoing discussion of certain of these embodiments does not necessarily represent a complete description of all possible embodiments. Therefore, the detailed description of the drawings, and the drawings themselves, disclose at least one preferred embodiment of the clamp braces and methods for manufacturing, selling, and using the same, and may disclose alternative embodiments of the clamp braces and methods for manufacturing, selling, and using the same.

All elements claimed in any particular claim are essential to the clamp braces or method for manufacturing, selling, or using the same claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. An apparatus to carry a portable device, the apparatus comprising:

a brace body;

an adjustment mechanism coupled to the brace body and configured to:

adjust the apparatus for an adjusted fit; and retain the adjusted fit for the apparatus;

and a clamp mechanism coupled to the brace body and configured to:

conform to a locked state to configure the apparatus for a bracing fit; and conform to an unlocked state to configure the apparatus for a relaxed fit;

wherein:

the bracing fit is configured to brace the apparatus at a usage position while the apparatus is in the adjusted fit;

the relaxed fit permits positioning of the apparatus relative to the usage position while the apparatus is in the adjusted fit or in a non-adjusted fit;

the brace body comprises:

a first brace portion routed from the clamp mechanism to the adjustment mechanism;

a second brace portion coupled to the first brace portion and routed from the adjustment mechanism back to the clamp mechanism; and a third brace portion coupled to the second brace portion and routed from the clamp mechanism back to the adjustment mechanism;

the clamp mechanism comprises a first clamp tab; and the first clamp tab is configured to overlap two or more of the first, second, or third brace portions of the brace body to configure the apparatus for the bracing fit when the clamp mechanism is in the locked state and regardless of whether the apparatus is in the adjusted fit or the non-adjusted fit.

2. The apparatus of claim 1, wherein:

the clamp mechanism comprises:

a hinge about which the first clamp tab pivots between the locked and unlocked states; and the brace body comprises:

a hinge brace portion coupled to the first brace portion and surrounding the hinge.

3. The apparatus of claim 1, wherein:

when the clamp mechanism is in the locked state:

the apparatus comprises an inner diameter area; and the brace body and the first clamp tab are overlapped such that:

the second brace portion comprises a first stack level;

the third brace portion comprises a second stack level;

the first clamp tab comprises a third stack level;

the second stack level is between the first and third stack levels; and the first stack level is furthest away from the inner diameter area.

4. The apparatus of claim 3, wherein:

when the clamp mechanism is in the locked state:

the brace body and the first clamp tab are overlapped such that:

the first brace portion comprises a fourth stack level;

the third stack level is between the second and fourth stack levels; and the fourth stack level is closest to the inner diameter area.

5. The apparatus of claim 1, wherein:

the brace body comprises:

a first brace band coupled to a first region of the clamp mechanism; and a second brace band coupled to a second region of the clamp mechanism; and when the clamp mechanism is in the locked state, the first and second brace bands overlap at least partially.

6. The apparatus of claim 1, wherein:

the adjustment mechanism comprises a glider buckle with a glider post coupled to the brace body and adjustable while the clamp mechanism is in the locked state;

the glider buckle is configured to slide along at least a portion of the brace body; and the brace body comprises a buckle brace portion coupled to the glider post and to the third brace portion.

7. The apparatus of claim 1, wherein:

the clamp mechanism comprises:

a hinge about which the first clamp tab pivots between the locked and unlocked states;

a second clamp tab coupled to the first clamp tab via the hinge;

a first clamp locking element at the first clamp tab; and a second clamp locking element at the second clamp tab;

the first clamp locking element at the first clamp tab is located at a first distance from the hinge;

the brace body couples to the first clamp tab at a second distance from the hinge;

the second distance is greater than the first distance; and the first and second clamp locking elements lock together and engage the clamp mechanism to the locked state after (a) the first clamp tab is rotated about the hinge towards the second clamp tab, or (b) the second clamp tab is rotated about the hinge towards the first clamp tab.

8. The apparatus of claim 7, wherein:

the first clamp tab comprises a first slot at the second distance from the hinge; and the brace body is routed through the first slot of the first clamp tab.

9. The apparatus of claim 8, wherein:

the second clamp tab comprises a second slot;

the second slot comprises the second clamp locking element; and the brace body is routed through the second slot of the second clamp tab.

10. The apparatus of claim 1, wherein:

the clamp mechanism further comprises a hinge and a curling to separate the hinge away from at least one of user skin or user clothing at the usage position.

11. The apparatus of claim 1, wherein:

the brace body comprises a single brace band routed through the clamp mechanism and through the adjustment mechanism.

12. The apparatus of claim 1, wherein:

the clamp mechanism comprises:

a hinge about which the first clamp tab pivots between the locked and unlocked states;

a second clamp tab coupled to the first clamp tab via the hinge;

a first clamp locking element at the first clamp tab; and a second clamp locking element at the second clamp tab;

the first clamp locking element comprises at least one of:

a first stub;

a first slot having a first slot edge;

a first magnetic element;

a first snap-button stud;

a first snap-button socket;

a first multi-hook material; or a first multi-loop material;

the second clamp locking element comprises at least one of:

a second slot having a second slot edge configured to couple with the first stub of the first clamp locking element;

a second stub configured to couple with the first slot edge of the first slot of the first clamp locking element;

a second magnetic element configured to couple with the first magnetic element of the first clamp locking element;

a second snap-button stud configured to couple with the first snap-button socket of the first clamp locking element;

a second snap-button socket configured to couple with the first snap-button stud of the first clamp locking element;

a second multi-hook material configured to couple with the first multi-loop material of the first clamp locking element; or a second multi-loop material configured to couple with the first multi-hook material of the first clamp locking element; and the first and second clamp locking elements lock together and engage the clamp mechanism to the locked state after the first clamp tab is rotated about the hinge towards the second clamp tab.

13. A clamp brace configured to wield a portable device, the clamp brace comprising:

a brace band;

an adjustment mechanism coupled to the brace band and configured to retain an adjusted fit for the clamp brace; and a clamping mechanism coupled to the brace band and comprising:

a top clamp tab with a top locking element and a top clamp tab inner side;

a bottom clamp tab with a bottom locking element and a bottom clamp tab inner side; and a hinge coupling together the top and bottom clamp tabs;

wherein:

the clamping mechanism alternates the clamp brace between a bracing fit and a relaxed fit upon pivoting of (a) the top clamp tab about the hinge relative to the bottom clamp tab, or (b) the bottom clamp tab about the hinge relative to the top clamp tab;

the relaxed fit comprises the top and bottom locking elements disengaged from each other; and the bracing fit comprises:

the top clamp tab inner side and the bottom clamp tab inner side facing each other;

the top and bottom locking elements coupled together; and two or more sections of the brace band overlapped with the top and bottom clamp tabs; and the brace band at least partially located between the top clamp tab inner side and the bottom clamp tab inner side.

14. The clamp brace of claim 13, wherein:

the hinge of the clamping mechanism hinges about a hinge axis; and the brace band comprises a hinge brace portion routed around the hinge axis of the hinge.

15. The clamp brace of claim 13, wherein:

the brace band comprises:

a first brace portion routed from the bottom clamp tab to the adjustment mechanism;

a second brace portion coupled to the first brace portion and routed from the adjustment mechanism to the top clamp tab; and a third brace portion coupled to the second brace portion and routed from the top clamp tab to the adjustment mechanism.

16. The clamp brace of claim 15, wherein:

a fourth brace portion of the brace band extends through a first slot of the bottom clamp tab;

the first brace portion extends from the fourth brace portion to a first slot of the adjustment mechanism;

the second brace portion extends from a second slot of the adjustment mechanism to a first slot of the top clamp tab;

the third brace portion extends from the first slot of the top clamp tab to the second slot of the adjustment mechanism;

a fifth brace portion of the brace band is coupled to the third brace portion and extends through the first and second slots of the adjustment mechanism;

the adjustment mechanism is configured to reposition the fifth brace portion along a length of the brace band to alter a diameter of the clamp brace; and the first brace portion extends along an underside of the bottom clamp tab from the fourth brace portion to a second slot of the bottom clamp tab opposite the hinge.

17. The clamp brace of claim 13, wherein:

the adjustment mechanism comprises a glider buckle adjustable while the clamp brace is set to the bracing fit by the clamping mechanism; and the clamp mechanism further comprises a curling to separate the hinge away from an interface surface at the bracing fit.

18. A method for providing an apparatus to carry a portable device, the method comprising:

providing a brace body;

providing an adjustment mechanism coupled to the brace body and configured to:

adjust the apparatus for an adjusted fit; and retain the adjusted fit for the apparatus; and providing a clamp mechanism coupled to the brace body and configured to:

conform to a locked state to configure the apparatus for a bracing fit; and conform to an unlocked state to configure the apparatus for a relaxed fit;

wherein:

the bracing fit is configured to brace the apparatus at a usage position;

the relaxed fit permits positioning of the apparatus relative to the usage position;

the brace body comprises:

a first brace portion routed from the clamp mechanism to the adjustment mechanism;

a second brace portion coupled to the first brace portion and routed from the adjustment mechanism back to the clamp mechanism; and a third brace portion coupled to the second brace portion and routed from the clamp mechanism back to the adjustment mechanism;

the clamp mechanism comprises a first clamp tab; and when in the locked state, the first clamp tab is configured to overlap at least two of the first, second, or third brace portions of the brace body to configure the apparatus for the bracing fit.

19. The method of claim 18, wherein:

the clamp mechanism comprises:

a hinge about which the first clamp tab pivots between the locked and unlocked states;

and the brace body comprises:

a hinge brace portion coupled to the first brace portion and surrounding the hinge.

20. The method of claim 18, wherein:

the clamp mechanism comprises:

the first clamp tab with a first locking element and a first clamp tab inner side;

a second clamp tab with a second locking element and a second clamp tab inner side; and a hinge coupling together the first and second clamp tabs;

wherein:

the clamping mechanism alternates the apparatus between the bracing fit and the relaxed fit upon pivoting of (a) the first clamp tab about the hinge relative to the second clamp tab, or (b) the second clamp tab about the hinge relative to the first clamp tab;

the relaxed fit comprises the first and second locking elements disengaged from each other; and the bracing fit comprises:

the first clamp tab inner side and the second clamp tab inner side facing each other;

the first and second locking elements coupled together;

two or more sections of the brace body overlapped with the first and second clamp tabs; and the brace body at least partially located between the first clamp tab inner side and the second clamp tab inner side.

* * * * *